US010429143B2

(12) United States Patent
Zajk

(10) Patent No.: US 10,429,143 B2
(45) Date of Patent: Oct. 1, 2019

(54) FIRE CONTROL INSERT FOR FIREARM

(71) Applicant: Sturm, Ruger & Company, Inc., Southport, CT (US)

(72) Inventor: Joseph J. Zajk, Prescott, AZ (US)

(73) Assignee: Sturm, Ruger & Company, Inc.

( * ) Notice: Subject to any disclaimer, the term of this patent is extended or adjusted under 35 U.S.C. 154(b) by 225 days.

(21) Appl. No.: 15/392,161

(22) Filed: Dec. 28, 2016

(65) Prior Publication Data

US 2017/0184365 A1 Jun. 29, 2017

Related U.S. Application Data

(60) Provisional application No. 62/271,472, filed on Dec. 28, 2015.

(51) Int. Cl.

| | |
|---|---|
| ***F41A 19/15*** | (2006.01) |
| ***F41A 17/56*** | (2006.01) |
| ***F41A 19/32*** | (2006.01) |
| ***F41A 19/10*** | (2006.01) |
| ***F41A 19/12*** | (2006.01) |
| ***F41A 19/30*** | (2006.01) |
| ***F41A 5/04*** | (2006.01) |
| ***F41A 5/06*** | (2006.01) |
| ***F41A 21/00*** | (2006.01) |
| ***F41C 3/00*** | (2006.01) |

(52) U.S. Cl.

CPC ..... *F41A 19/15* (2013.01); *F41A 5/04* (2013.01); *F41A 5/06* (2013.01); *F41A 17/56* (2013.01); *F41A 19/10* (2013.01); *F41A 19/12* (2013.01); *F41A 19/30* (2013.01); *F41A 19/32* (2013.01); *F41A 21/00* (2013.01); *F41C 3/00* (2013.01)

(58) Field of Classification Search

CPC ..... F41A 19/10; F41A 19/12; F41A 19/15; F41A 19/14; F41A 19/32; F41A 3/66; F41A 17/46; F41A 17/56; F41A 5/04; F41C 3/00

See application file for complete search history.

(56) References Cited

U.S. PATENT DOCUMENTS

| | | | | |
|---|---|---|---|---|
| 970,307 A | | 9/1910 | Clement | |
| 5,157,209 A | * | 10/1992 | Dunn | F41A 17/64 42/70.08 |
| 6,234,059 B1 | * | 5/2001 | Fuchs | F41A 3/66 89/195 |
| 6,260,301 B1 | | 7/2001 | Aigner et al. | |
| 6,263,607 B1 | | 7/2001 | Fuchs et al. | |

(Continued)

*Primary Examiner* — Benjamin P Lee

(74) *Attorney, Agent, or Firm* — The Belles Group, P.C.

(57) ABSTRACT

A firearm comprises a frame and firing control housing insert detachably mounted in the frame. A rear securement feature includes a locking slot formed in the rear wall of the insert engaging a locking protrusion formed in the rear wall of the frame which retains the rear portion of the insert in the frame. A front securement feature includes a rotatable pin inserted through holes in the insert front portion and frame. A radial retention protrusion on the pin is interposed between the insert and frame defining an interlock feature. The pin is rotatable into a first position wherein the protrusion passes through a complementary configured frame aperture allowing the pin to be removed, and a second position wherein the protrusion is not aligned with the aperture to engage the frame and prevent pin removal.

18 Claims, 34 Drawing Sheets

(56) References Cited

U.S. PATENT DOCUMENTS

| | | | | |
|---|---|---|---|---|
| 6,407,379 | B1 | 6/2002 | Shinbo | |
| 6,571,501 | B1 | 6/2003 | Jennings | |
| 6,993,864 | B1 | 2/2006 | O'Clair et al. | |
| 7,162,824 | B1 | 1/2007 | McCormick | |
| 7,472,507 | B2 * | 1/2009 | Curry | F41A 19/15 42/14 |
| 7,617,628 | B2 * | 11/2009 | Curry | F41A 19/28 42/70.02 |
| 7,703,230 | B2 * | 4/2010 | Curry | F41A 17/72 42/70.01 |
| 7,992,335 | B2 | 8/2011 | Gangl | |
| 8,132,496 | B2 * | 3/2012 | Zukowski | F41A 17/66 42/70.01 |
| 8,485,086 | B2 * | 7/2013 | Alis | F41A 3/10 89/196 |
| 9,046,313 | B1 | 6/2015 | Lutton et al. | |
| 9,303,936 | B2 * | 4/2016 | Toner | F41A 17/62 |
| 9,383,153 | B2 * | 7/2016 | Nebeker | F41A 17/72 |
| 9,689,635 | B2 * | 6/2017 | Krieger | F41A 17/64 |
| 10,119,777 | B2 * | 11/2018 | Wolf | F41A 19/15 |
| 2006/0249014 | A1 * | 11/2006 | Curry | F41A 11/00 89/196 |
| 2011/0030545 | A1 | 2/2011 | Klein | |
| 2011/0185615 | A1 | 8/2011 | Gangl | |
| 2015/0292828 | A1 * | 10/2015 | Nebeker | F41A 17/72 42/69.01 |
| 2018/0372437 | A1 * | 12/2018 | Hudson, III | F41A 19/15 |

* cited by examiner

FIG. 7
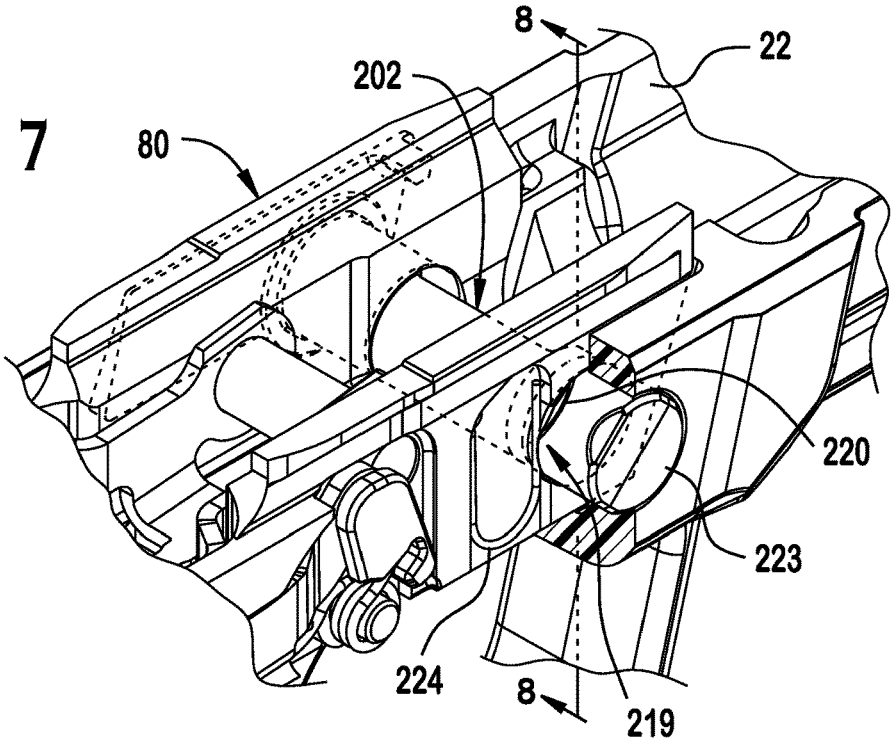
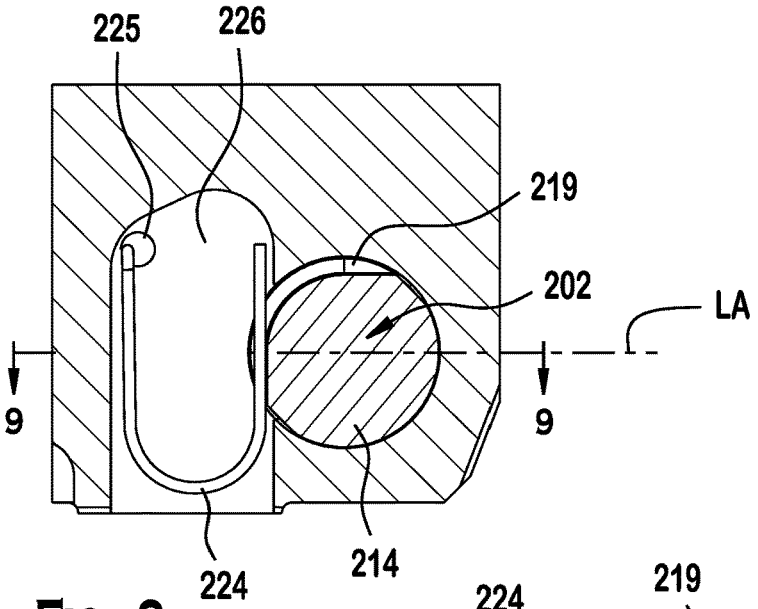
FIG. 8
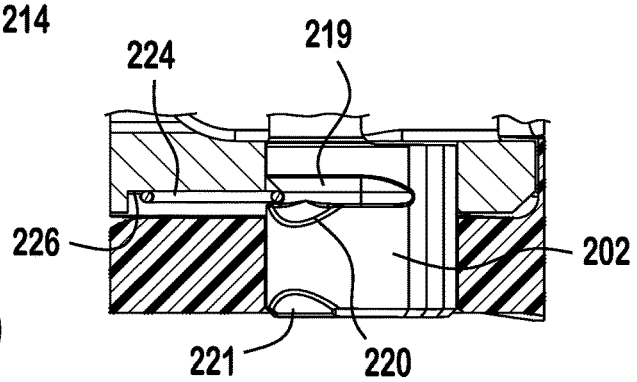
FIG. 9

FIRE CONTROL INSERT FOR FIREARM

CROSS-REFERENCE TO RELATED APPLICATIONS

The present application claims the benefit of priority to U.S. Provisional Application No. 62/271,472, filed Dec. 28, 2015, which is incorporated herein by reference in its entirety.

BACKGROUND OF THE INVENTION

The present invention generally relates to firearms, and more particularly to a system for mounting a firing mechanism in auto-loading firearms.

Firearms such as auto-loading pistols come in a variety of full size and compact platforms. A trigger-actuated firing mechanism is provided which is operated by a user to discharge the firearm. To accomplish this action, the firing mechanism comprises multiple interactive components which generally include a movable trigger mechanically linked to a hammer-firing pin assembly or alternatively a striker either of which functions to strike and detonate a chambered round. Various intermediate firing mechanism components are operably linked between the trigger and firing pin or striker to control discharge of the firearm. Various approaches have been used for mounting the firing mechanism components in the frame of the firearm.

An improved firing mechanism mounting system is desired.

SUMMARY OF THE INVENTION

According to various aspects of the invention, a firearm is provided having an improved system for mounting the firing mechanism components in the frame of the firearm. A related method for mounting the firing mechanism in a firearm is further disclosed. In one non-limiting embodiment, the firearm may be an autoloading firearm.

According to one aspect, a firearm with removable firing control housing insert includes: a longitudinal axis; a frame including a pair of right and left sidewalls, a rear wall extending transversely between the sidewalls, an open top, and an axially elongated cavity accessible through the open top; an axially elongated firing control housing insert including a front end, a rear end, and pair lateral sidewalls extending between the ends; the insert detachably mounted in the cavity and configured for holding firing mechanism components, the insert being removable from the cavity through the open top of the frame; an elongated locking slot formed in a rear wall of the insert engaging a forwardly projecting locking protrusion formed in the rear wall of the frame, the locking slot and protrusion operable to retain a rear end of the insert in the frame.

According to another aspect, a frame and firing control housing insert assembly for a firearm includes: an axially elongated firing control housing insert removably inserted into an upwardly open cavity of a firearm frame, the insert including a longitudinal axis, a front portion configured for mounting a trigger assembly of the firearm, a rear portion configured for mounting components of a firing mechanism of the firearm, and a pair of spaced apart struts connecting the front and rear portions; a rear securement feature comprising a locking slot formed in a rear wall of the insert engaged with a complementary configured locking protrusion formed in a rear wall of the frame; a front securement feature comprising a transversely mounted rotatable retention pin inserted laterally through a first pair of holes in the front portion of the insert and a second pair of holes in the frame; a radially extending operating lever arranged on a first end of the pin for rotating the pin; and an interlock feature comprising a radially extending retention protrusion on the pin interposed between the insert and frame proximate to a first hole of the second pair of holes in the frame; the pin being rotatable between a first removal position wherein the protrusion is aligned to pass through a complementary configured frame aperture allowing the pin to be removed from the frame, and a second engagement position wherein the protrusion is not aligned with the aperture to engage the frame and prevent the pin from being removed from the frame.

A method for mounting a firing control housing insert in a firearm is provided. The method includes: providing a firearm having a longitudinal axis and a frame defining an elongated cavity; inserting the firing control housing insert into the cavity; engaging a slot formed in a rear wall of the insert with a mating protrusion formed in a rear wall of the frame; aligning a radially extending retention protrusion on a cylindrical retention pin with a complementary configured removal aperture in the frame; inserting the pin in a transverse direction through concentrically aligned holes in the insert and frame, the pin being in the first rotational removal position; and rotating the pin into a second rotational engagement position in which the retention protrusion is misaligned with the removal aperture in the frame which prevents removing the pin from the frame in the transverse direction.

BRIEF DESCRIPTION OF THE DRAWINGS

The features of the preferred embodiments will be described with reference to the following drawings where like elements are labeled similarly, and in which:

FIG. 7 is a partial right side perspective view showing a portion of the firing control housing insert and frame showing the takedown pin and operating lever in a horizontal operating position;

FIG. 8 is an enlarged cross sectional detail taken from FIG. 7;

FIG. 9 is a cross sectional detail taken from FIG. 8;

Figure 1:
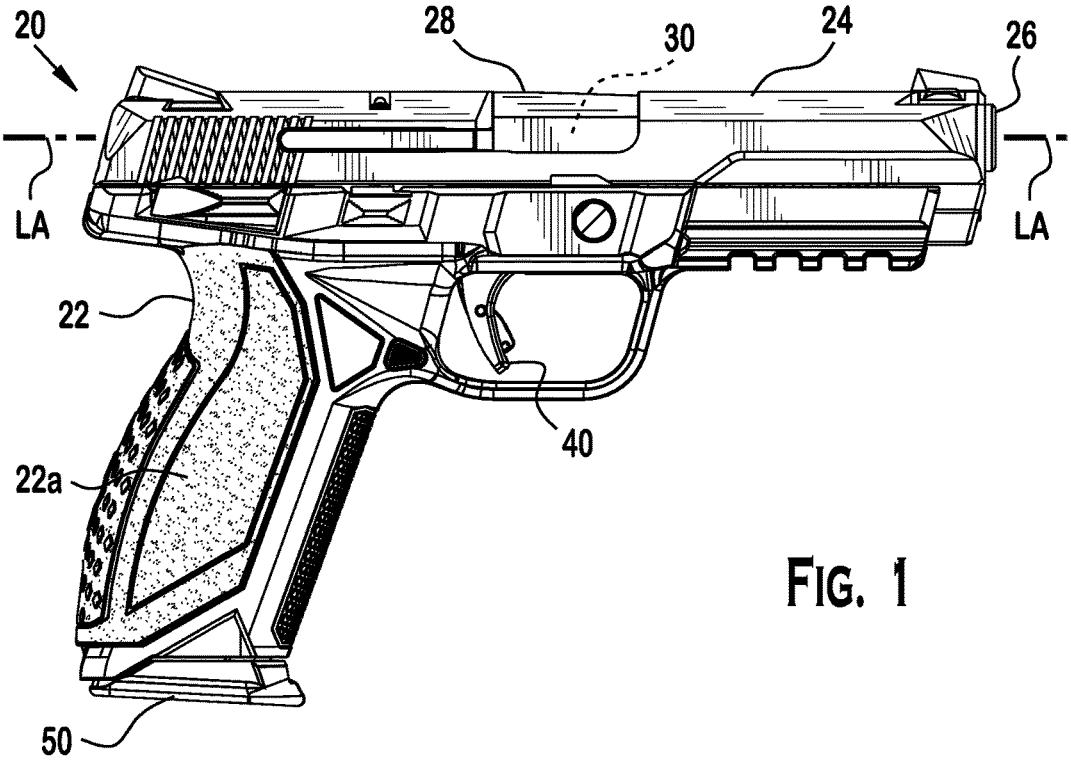
FIG. 1 is a right side view of a pistol according to the present disclosure.

All drawing shown herein are schematic and not to scale. A reference to certain figures in the Detailed Description which follows shall be construed as examples where certain components are shown recognizing that the components may appear in other figures. Components numbered in certain figures shall be construed to be the same components where they appear unnumbered in other figures for brevity.

DETAILED DESCRIPTION

The features and benefits of the invention are illustrated and described herein by reference to preferred embodiments. This description of preferred embodiments is intended to be read in connection with the accompanying drawings, which are to be considered part of the entire written description. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. As the terms are used herein, "forward" indicates an axial direction towards the muzzle end of the firearm and "rearward" indicates an opposite axial direction.

An exemplary auto-loading firearm incorporating an embodiment of a firing control mechanism according to the present disclosure will now be described with non-limiting reference to a semi-automatic pistol. The principles and features of the embodiments disclosed herein, however, may be embodied with equal benefit in other types of auto-loading firearms such as rifles. Accordingly, the invention is not limited in its applicability or scope to pistols alone as described herein.

Figure 2:
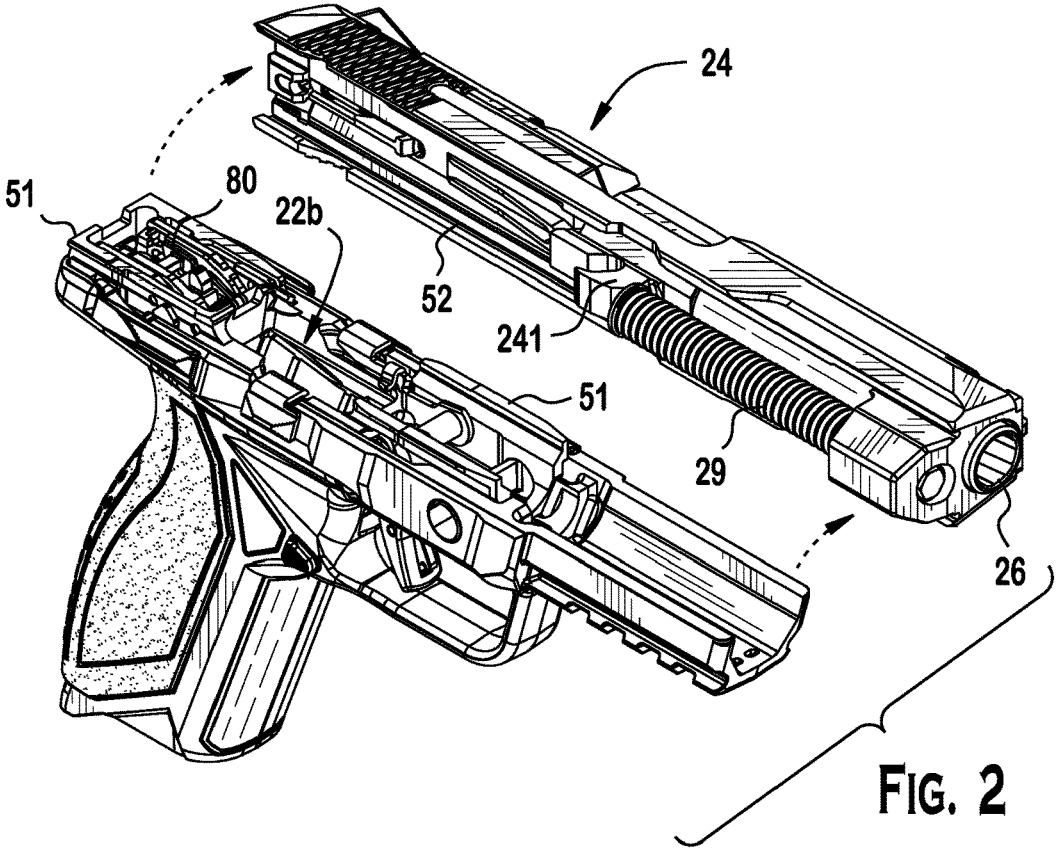
FIG. 2 is a right side exploded perspective view thereof showing the slide removed from the pistol frame.
Figure 3:
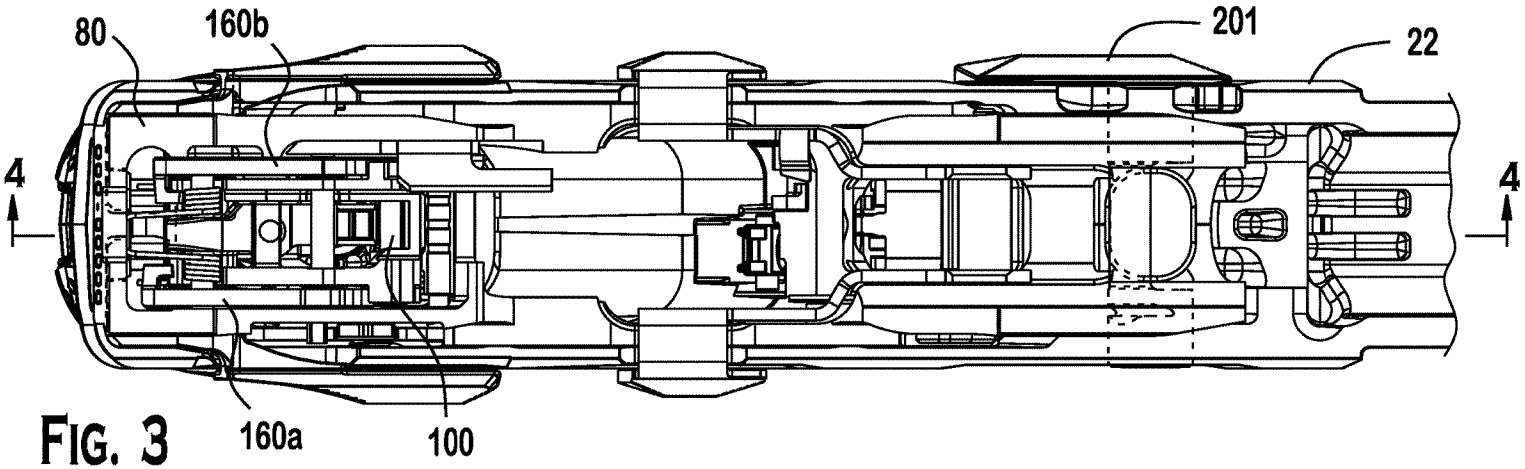
FIG. 3 is a top plan view thereof with slide removed to show the firing control housing insert, firing mechanism components, and trigger assembly components.

FIG. 1 depicts a right side view of an auto-loading firearm in the form of a pistol 20 including a firing control mechanism mounting system according to the present disclosure. FIG. 2 depicts the pistol with the slide removed from the grip frame and rotated 90 degrees to better show the components of the firing mechanism mounted in the firearm frame.

Referring now to FIGS. 1-2, pistol 20 includes a grip frame 22 having a rear downwardly extending grip portion 22*a* for grasping. Grip frame 22 further includes two longitudinally extending right and left sidewalls 22*c*, 22*d* and rear wall 22*e* (see, e.g. FIGS. 42-46). An elongated longitudinally-extending cavity 22*b* is defined by the sidewalls 22*c*, 22*d* which opens upwards and receives firing control housing insert 80 therein (see FIG. 7). Firing control housing insert 80 supports various firing control mechanism components further described herein which advantageously may be mounted therein prior to installing the insert into the frame 22 to facilitate assembly of the pistol. Accordingly, the firing control housing insert 80 with firing control mechanism components is mountable in and removable from frame 22 as a separate self-supporting unit. Advantageously, this allows the firing control components to be pre-mounted in the insert 80 in a simplified and more readily accessible manner rather than mounting the components individually in the frame 22.

The action and firing mechanism in addition to the firing control housing will respectively now be further described in turn below.

Action and Firing Mechanism

Referring to FIGS. 1-2 and 26-27, a slide 24 is slideably mounted on pistol 20 via a pair of laterally spaced apart opposing longitudinal support rails 51 and mating longitudinal grooves 52 formed on the underside of the slide for axial reciprocating movement forwards and rearwards thereon in a manner well known in the art. In one non-limiting embodiment, at least a portion of the rails 51 may be formed on the firing control housing insert 80 and other portions on the frame 22 (see also FIG. 7). In some embodiments all rails 51 may be formed on the insert 80. A longitudinally extending elongated pocket 25 is formed on the right bottom surface 27 of slide 24 between its front and rear ends (closer to the rear in one embodiment). Pocket 25 is positioned for receiving the top portion of bulbous rear end 55 of trigger bar 42 when the pistol 20 is in the cocked ready-to-fire position allowing the trigger bar to be in an upward spring-biased position, as further described herein.

Recoil spring 29 operably associated with slide 24 acts to return the slide to the forward position shown in FIG. 1 after discharging pistol 20. A magazine 50 may be removably inserted into a generally vertical magazine well formed inside grip frame 22 in a known manner. Magazine 50 is sized and configured for holding and dispensing a plurality of ammunition cartridges.

Pistol 20 further includes a barrel 26 having an axial bore defining a pathway for a projectile. Barrel 26 is movably disposed at least partially inside slide 24. Pistol 20 defines a longitudinal axis LA (and axial direction) which is concentrically aligned with barrel 26 and slide 24 as shown in FIG. 1. Barrel 26 is moveable rearwards at least partially with slide 24 in relation to frame 22 under recoil after discharging pistol 20 or when manually cycling the action. A rear chamber block 28 is formed in barrel 26 defining a rearwardly open chamber 30 therein configured for receiving a cartridge (reference also FIG. 26). A breech area 23 is defined at the rear of barrel 26 and chamber 30 in the slide 24 for loading cartridges therein from magazine 50. Slide 24 includes a breech block defining a breech face 53 which is axially moveable with the slide in relation to the chamber 30 to alternatingly form an open or closed breech in a manner well known in the art. Breech block 53 includes a frontal hole through which the tip of striker 65 may be projected forward to strike a chambered cartridge C.

Figure 22:
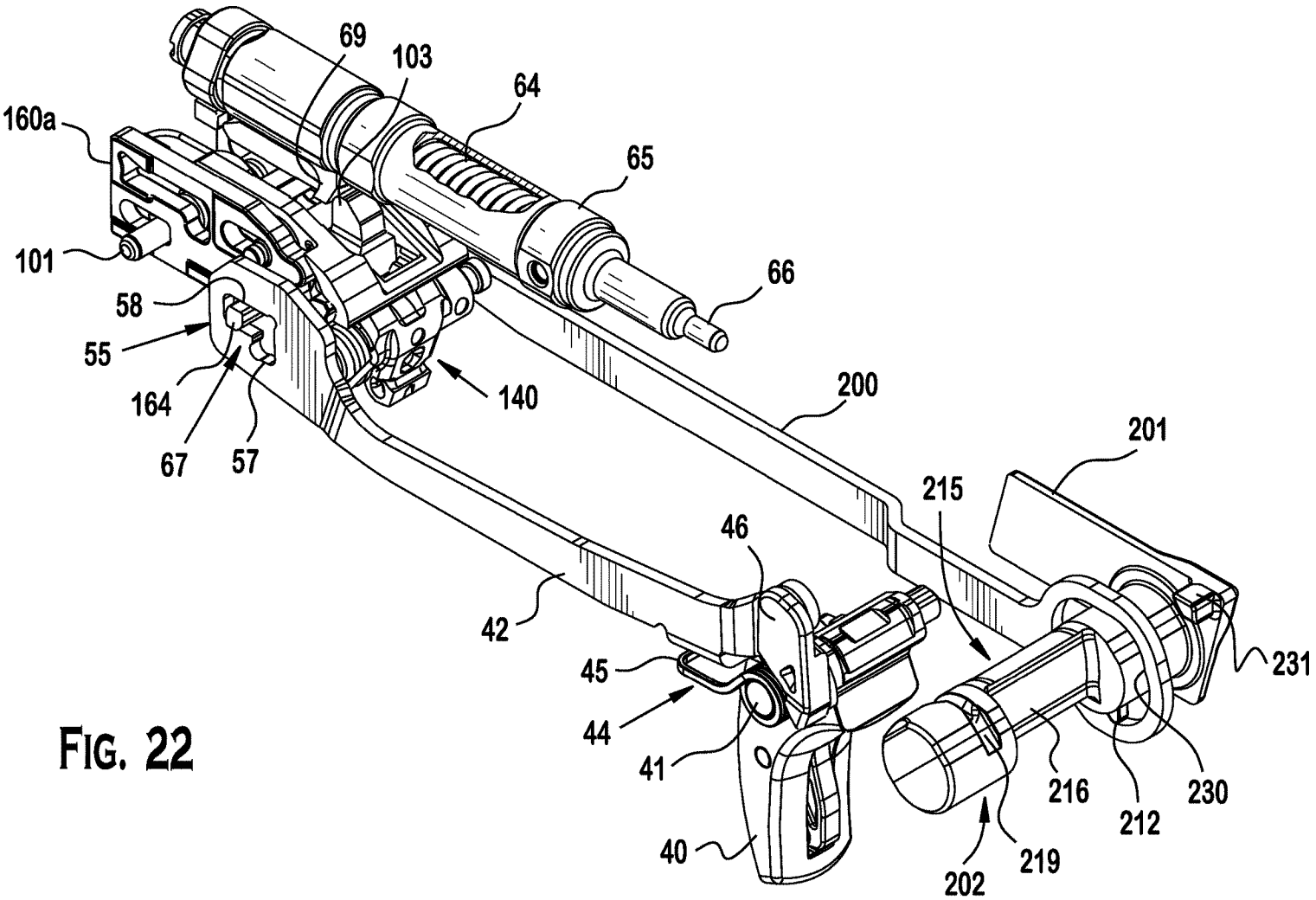
FIG. 22 is a top right perspective view of the firing, trigger, and takedown mechanisms of the pistol.
Figure 23:
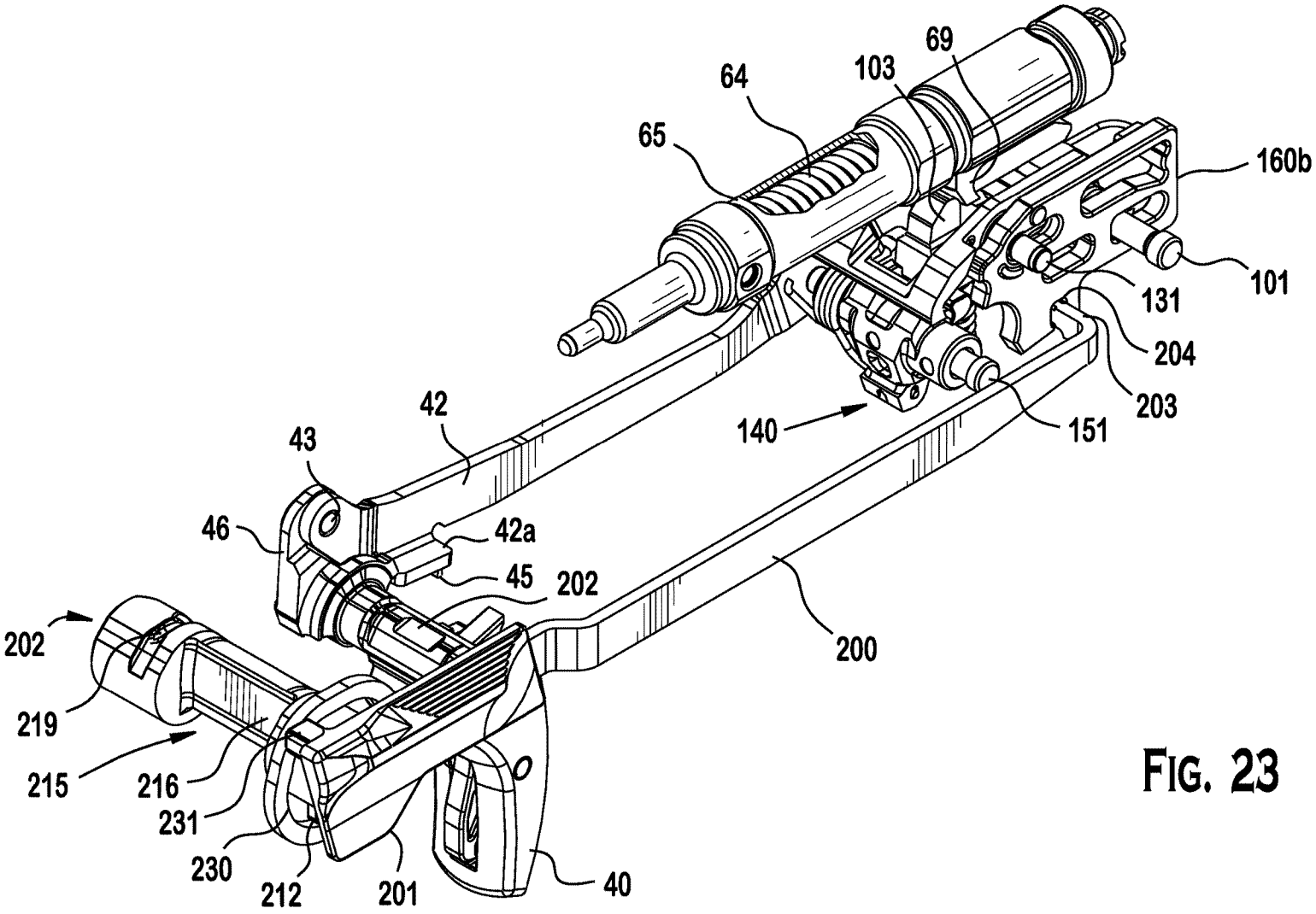
FIG. 23 is top left perspective view thereof.

FIGS. 22 and 23 show the firing control mechanism disembodied from the pistol grip frame 22 and firing control housing insert 80 for clarity.

Referring to FIGS. 1-2, 22-23, and 26-27, a firing control mechanism in one embodiment includes a trigger assembly including a trigger 40 pivotally mounted in frame 22 to firing control housing insert 80 via transverse pin 41 and an axially (longitudinally) movable trigger bar 42 pivotally coupled to the trigger via transverse pin 43 on an upward trigger pivot extension 46. An axially linearly movable spring-loaded striker 65 is supported by slide 24 for rearward retraction/recoil and forward release to strike a chambered cartridge for discharging pistol 20. The striker 65 is actuated and released via the trigger assembly through a trigger pull. Accordingly, the combination of the trigger assembly and striker 65 together define a means for striking and detonating a chambered cartridge to discharge pistol 20.

Figure 18:
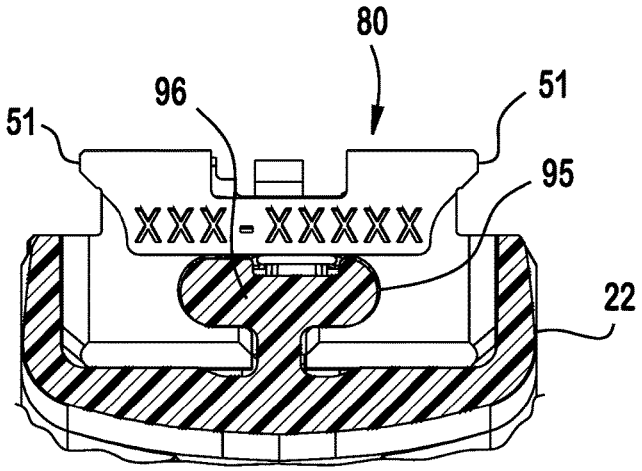
FIG. 18 is a partial rear cross sectional view showing the securement features in an assembled position.

Striker 65 has a generally cylindrical body and is axially elongated in structure. Referring further to FIGS. 8-11, striker 65 may include a forward diametrically narrowed portion 66 which defines a terminal front tip configured to striker the primer cap of chambered cartridge C (see also FIG. 18). A downward projecting striker catch rail 69 is located on the bottom of the striker 65 for engaging the sear 100 to hold the striker in a cocked rearward ready-to-fire position (see also FIGS. 9-11). Catch rail 69 is axially elongated having a longitudinal flat bottom surface defining a cam track 70 and a flat obliquely angled sear bearing surface 68 at the front of the protrusion, both of which engage the sear 100 for different purposes during readying the pistol 20 for firing and subsequent discharge, as further described herein. Sear bearing surface 68 has a forward-downward facing angled orientation with respect to longitudinal axis LA and cam track 70 in one embodiment. Accordingly, surface 68 therefore slopes downward from the top front portion to bottom rear portion. In other possible embodiments contemplated, sear bearing surface 68 may be convexly or concavely shaped rather than flat. Striker 65 is preferably made of a suitable metal, such as steel or other. The striker catch rail 69 may be a separate component fixedly attached to the striker 65 body or be an integral unitary structural part of the striker being formed with the body.

Striker spring 64 biases striker 65 with striker catch rail 69 forward for linear axial movement (i.e. along longitudinal axis LA) to strike a chambered cartridge when released via trigger pull. Spring 64 may be coiled concentrically around a portion of striker 65 in one embodiment. Striker spring 64 may be a helical compression coil spring in one embodiment, or other suitable type spring operable to bias the striker 65 forwards towards the chamber 30. Striker 65 may have a diametrically narrowed front end 66 configured to contact the rear of cartridge for detonation.

Figure 4:
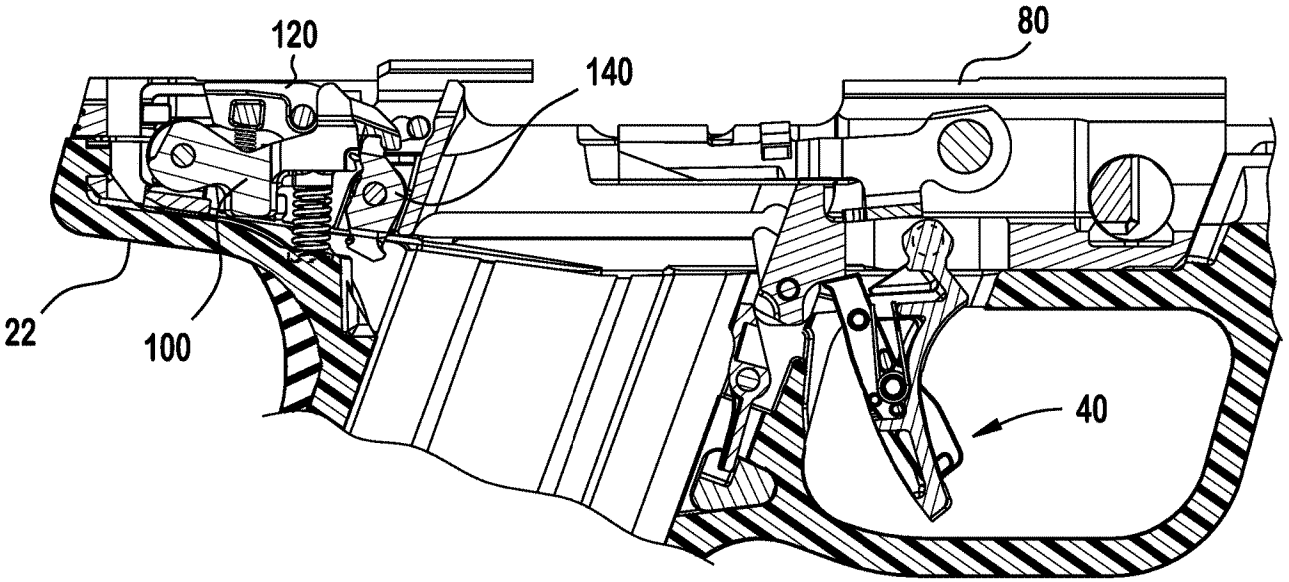
FIG. 4 is a partial right side cross sectional view thereof.
Figure 10:
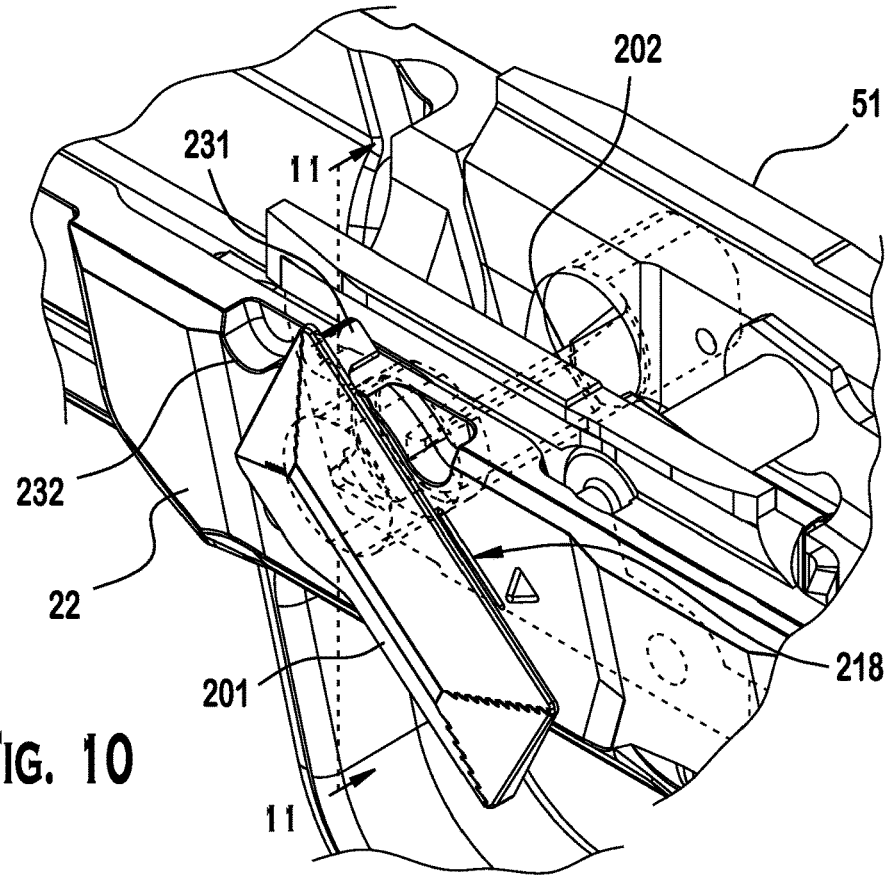
FIG. 10 is a partial left side perspective view showing a portion of the firing control housing insert and frame showing the takedown pin and operating lever in a second removal position.
Figure 11:
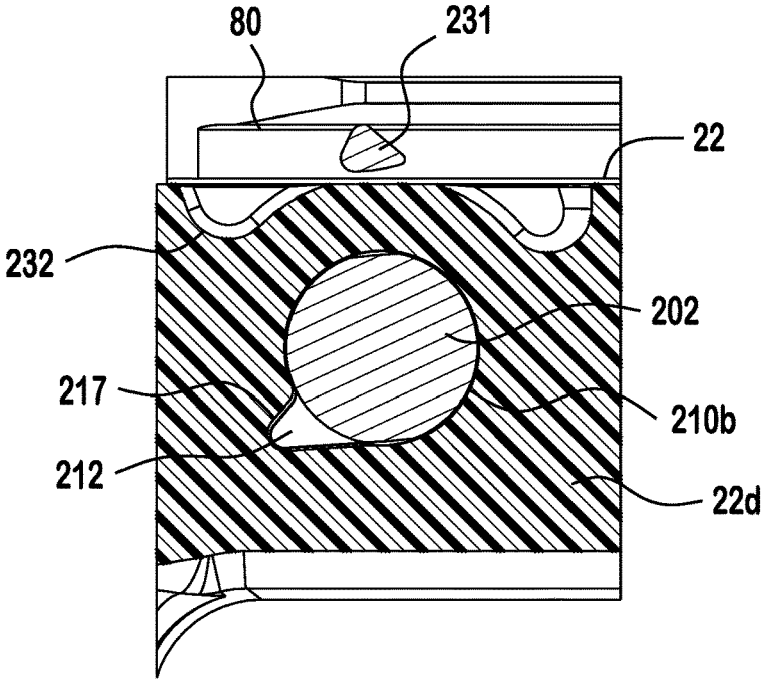
FIG. 11 is a cross sectional detail taken from FIG. 10.

A trigger return spring 44 may further be provided which in one embodiment may be a torsion spring that is mounted about trigger pin 41 and biases trigger 40 toward the fully forward ready-to-fire position (see, e.g. FIGS. 9-11). With continuing reference to FIGS. 1-4, trigger spring 44 may further include a rearwardly extending leg 45 with a lateral extension which acts on the underside of trigger bar 42 to bias the trigger bar upwards. In one embodiment, leg 45 may engage the underside of a laterally inward extending protrusion **42*a* on trigger bar 42 as best shown in FIG. 4 to help maintain positive engagement between spring 44** and the trigger bar.

Referring to FIGS. 3-8, the firing control mechanism in one embodiment may include sear 100, sear connector blocker 120 (safety), sear connector 140, and sear connector actuator 160. Sear 100 is configured and operable to selectively retain and release the striker 65 from the rearward cocked position for firing the pistol 20. The sear connector blocker 120, sear connector 140, and sear connector actuator 160 interact and function to both actuate the sear for firing pistol 20 via a trigger pull and further to prevent unintentional discharge of the pistol in the absence of a trigger pull, as further described herein. These foregoing firing control components may be operably and moveably supported by firing control housing insert 80, described further below. It will be appreciated that in other possible embodiments, any or all of the foregoing firing control components may be supported directly by the frame 22.

Referring to FIGS. 22-27 and 62, sear 100 has a horizontally elongated body defining a front end 108 and rear end 109. Sear 100 is pivotably supported by the firing control housing insert 80 via transverse sear mounting pin 101 which passes through a lateral mounting hole 102 in the sear that defines a pivot axis. In one embodiment, mounting hole 102 may be disposed proximate to rear end 109 of the sear. Pin 101 further passes through opposing holes 87 in the sidewalls 82, 83 of the insert 80 and horizontally elongated slots 161 formed in right and left members 160*a*, 160*b* of sear connector actuator 160. The slotted arrangement of sear connector actuator 160 permit longitudinal linear movement of the actuator with respect to the sear pin 101, firing control housing insert 80, and frame 22 in response to a trigger pull for firing the pistol 20.

For engaging and holding the striker 65 in a cocked ready-to-fire position, sear 100 further includes an upward projecting catch protrusion 103 oriented transversely to longitudinal axis LA. Protrusion 103 defines a generally rearward facing striker catch surface 104 engageable with the generally forward facing sear bearing surface 68 formed on downward extending striker catch rail 69 on striker 65. In one embodiment, striker catch surface 104 may be disposed above and forward of sear pin 101 proximate to front end 108 of sear 100.

In one embodiment, striker catch surface 104 may include an arcuately-rounded top convex camming portion 114 positioned to engage sear bearing surface 68 and cam track 70 on striker 65. Camming portion 114 is formed above a vertical flat portion of surface 104 at or proximate to the top of catch protrusion 103 which may be rounded. The convex camming portion 114 contact with flat sear bearing surface 68 provides smooth engagement with the striker and operation of the firing mechanism. This angled flat-to-convex mating surface arrangement creates a line of action on the upward catch protrusion 103 of striker 100 that acts to rotate sear 100 downward and forward under the biasing force of striker spring 64 when the sear is released by the sear connector 140 (see, e.g. FIG. 27).

Figure 26:
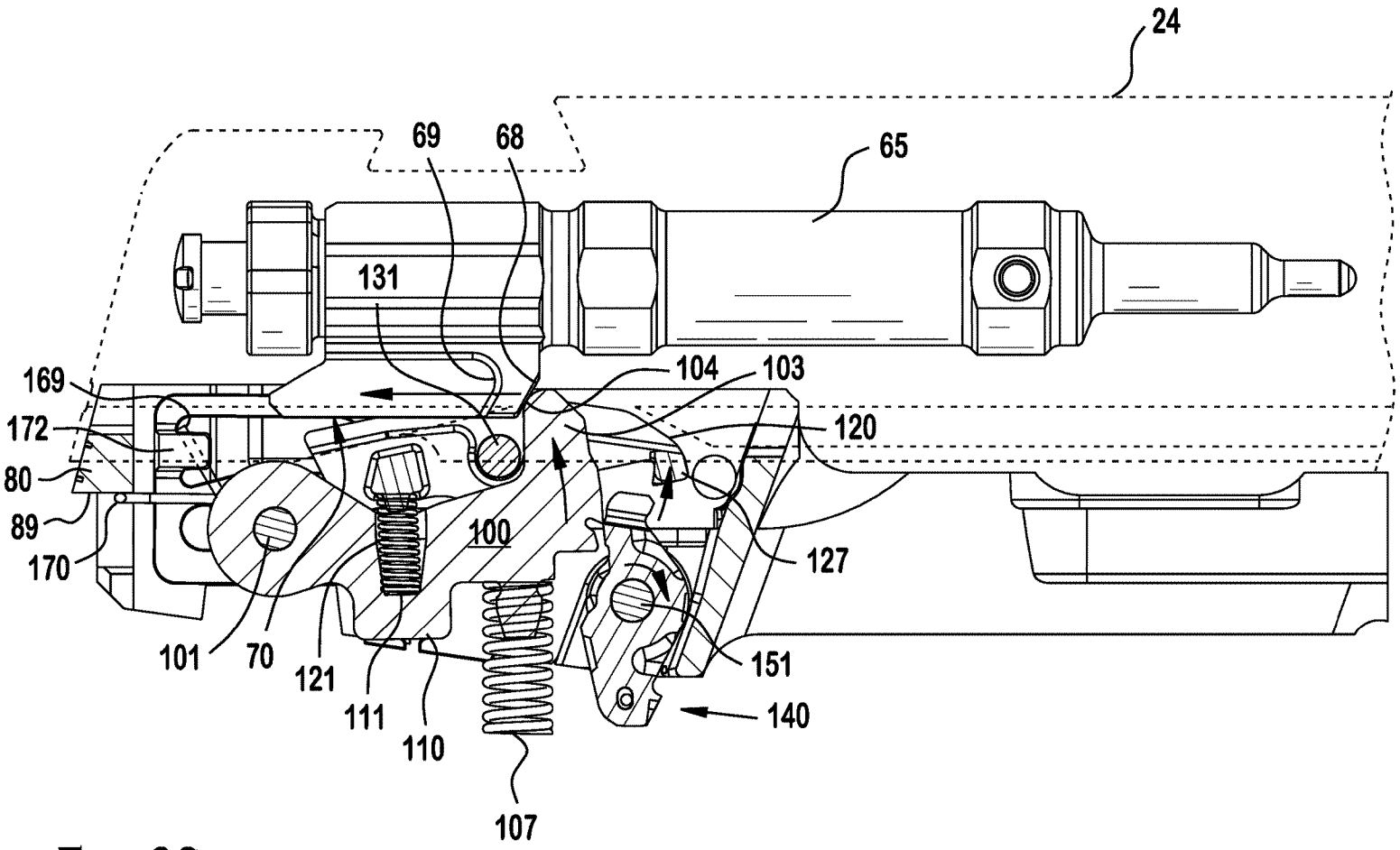
FIG. 26 is a right side view of the firing mechanism with a rear portion of the frame.

Sear 100 is biased in an upward and rearward counterclockwise direction about sear pin 101 by sear spring 107 (as viewed in FIG. 26). In one embodiment, sear spring 107 may be a helical compression spring; however, other suitable types of springs including torsion springs may be used to bias sear 100 in the desired manner. Sear spring 107 may act on a downward facing bottom surface 105 on a front portion of sear 100 that disposed below upward catch protrusion 103 forward of sear pin 101. In one embodiment, spring 107 has a line of action which may be precisely or proximately vertically aligned with vertical striker catch surface 104 to create positive engagement with striker catch rail 69 when holding striker 65 in a cocked ready-to-fire position. A downwardly extending spring retention post may be formed may be formed on bottom surface 105 of the sear to retain the upper end of spring 107 in the desired position.

Sear 100 may further include centrally located enlarged boss 110 which forms an upwardly open socket 111 configured for receiving and retaining sear blocker spring 134. Boss 110 may be formed proximate to the midpoint between ends 108 and 109 of sear 100. In one embodiment, boss 110 includes a downward projecting portion which extends below mounting hole 102. The boss may have a generally cylindrical structure in one embodiment.

Figure 27:
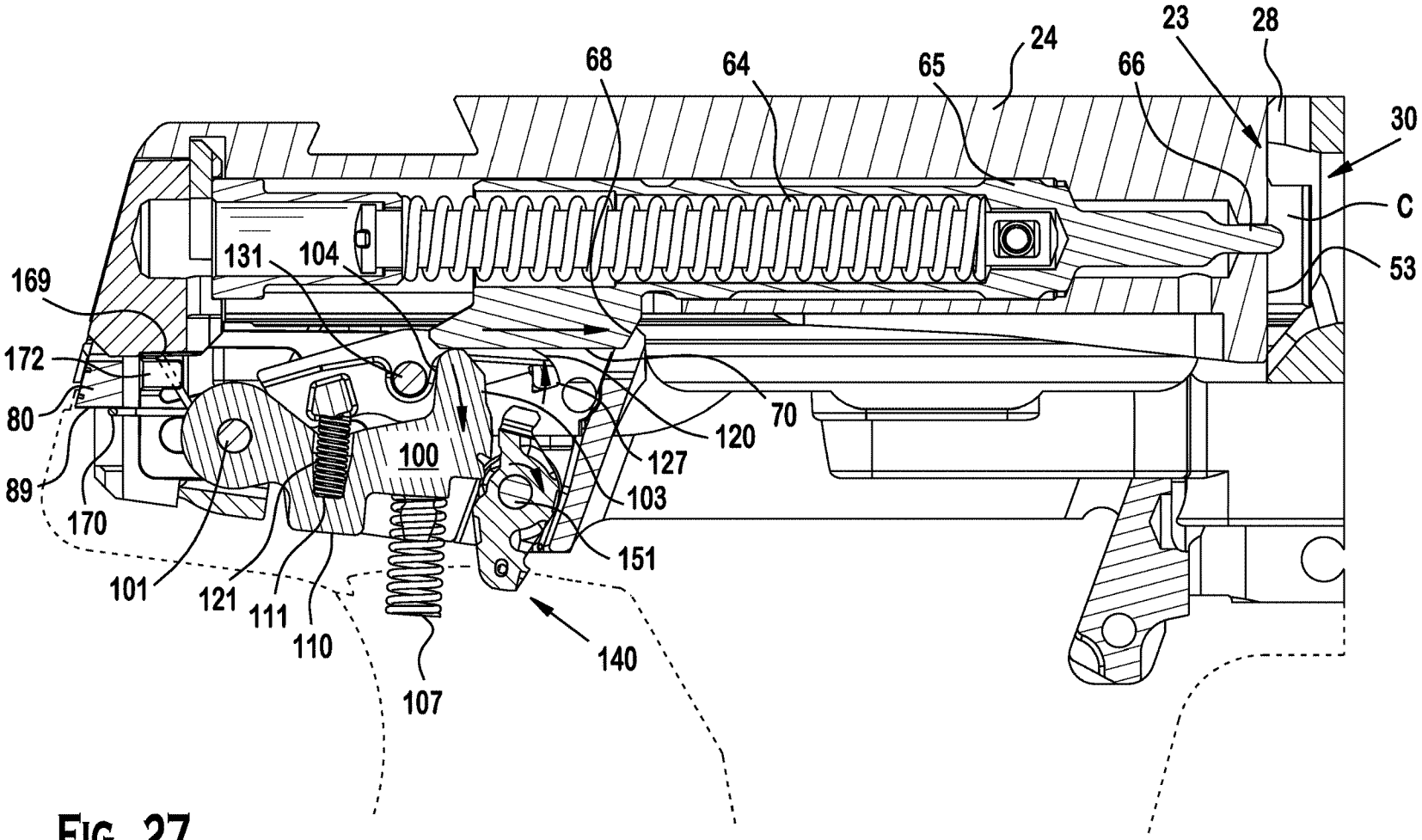
FIG. 27 is a right side view thereof showing the slide.
Figure 28:
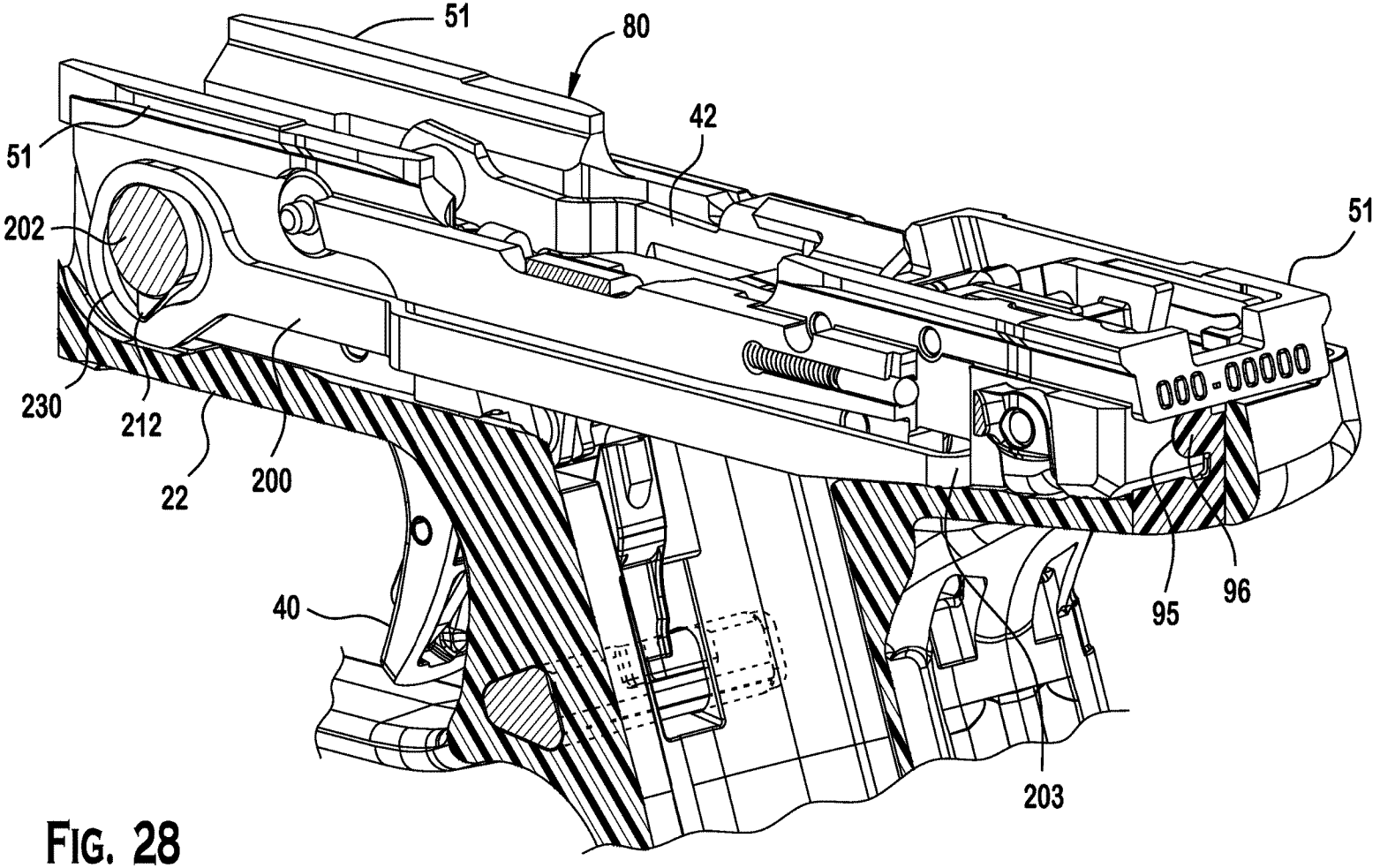
FIG. 28 is a left cross sectional perspective view of a rear portion the pistol showing the firing control housing insert, frame, and firing, takedown, and trigger mechanisms.

Sear 100 is pivotably moveable via a trigger pull between an upward engaged position holding the striker 65 in the rearward cocked position thereby preventing forward linear movement of the striker (FIG. 26) and a rotated downward release position thereby releasing the striker to strike and detonate chambered cartridge (FIG. 27). In the engaged position, catch protrusion 103 of sear 100 is in a substantially vertically upright position. In the rotated release position, the catch protrusion 103 is moved lower than in the engaged position with respect to the longitudinal axis LA and frame 22 of the pistol 20.

Sear connector 140 operably interacts with and is configured to retain sear 100 in the upward engaged position with the striker 65 until the connector is actuated by the sear connector actuator 160. Sear connector 140 is positioned forward of sear 100 in firing control housing insert 80. Sear connector 140 includes a top and bottom. The sear connector 140 may have a laterally widened body including a lateral mounting hole 141 formed in a transversely extending central tubular portion 140*a* of the body for receiving transverse sear connector mounting pin 151 which defines a pivot axis. Mounting pin 151 is positioned forward and lower than sear mounting pin 101 in one non-limiting embodiment. Sear connector 140 further includes spring 146 which biases latching surfaces 145 rearward (i.e. counterclockwise in FIG. 26) to positively engage the sear when in the upper engaged position with the sear as shown. Any suitable type of spring may be provided. In one non-limiting embodiment, for example, spring 146 may be a torsion spring.

Figure 59:
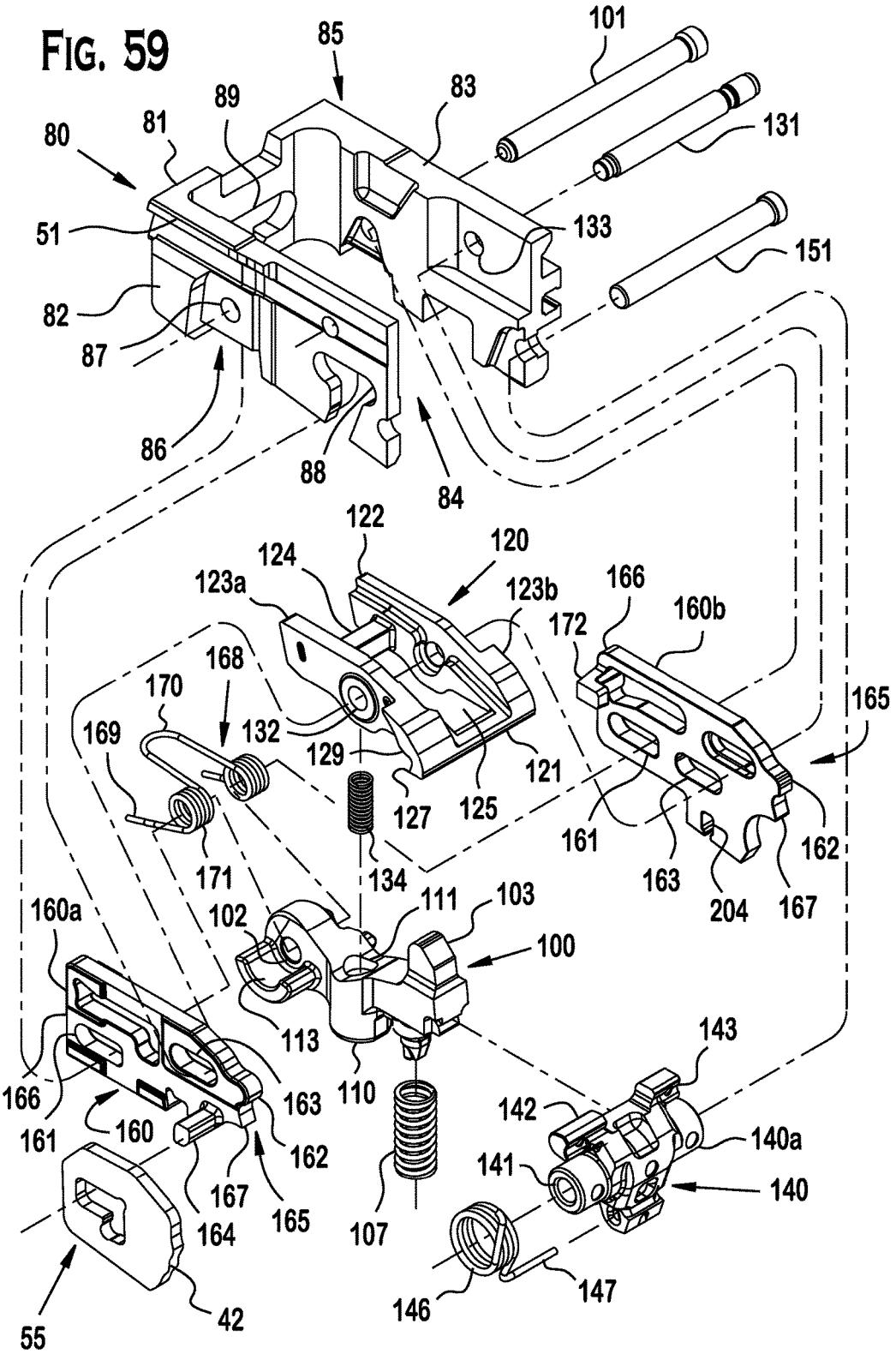
FIG. 59 is an exploded perspective view of the firing mechanism mounting system and components including the rear portion of the firing control housing insert.

Referring to FIG. 59, sear connector blocker 120 has a body including a pair of laterally spaced apart elongated sides 123*a*, 123*b* oriented axially (i.e. along longitudinal axis LA), front end 121, rear end 122, and lateral cross-piece 124 connecting the two sides together. A longitudinally extending slot 125 having an open top and bottom is formed between sides 123*a*, 123*b* that receives a portion of sear upward catch protrusion 103, thereby permitting engagement with striker catch rail 69.

Figure 50:
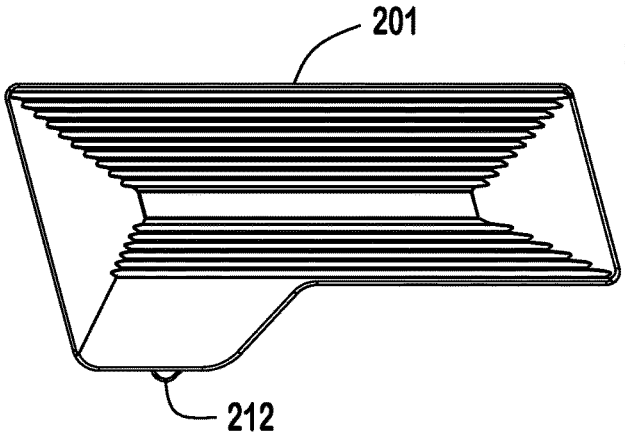
FIG. 50 is a left side view thereof.
Figure 51:
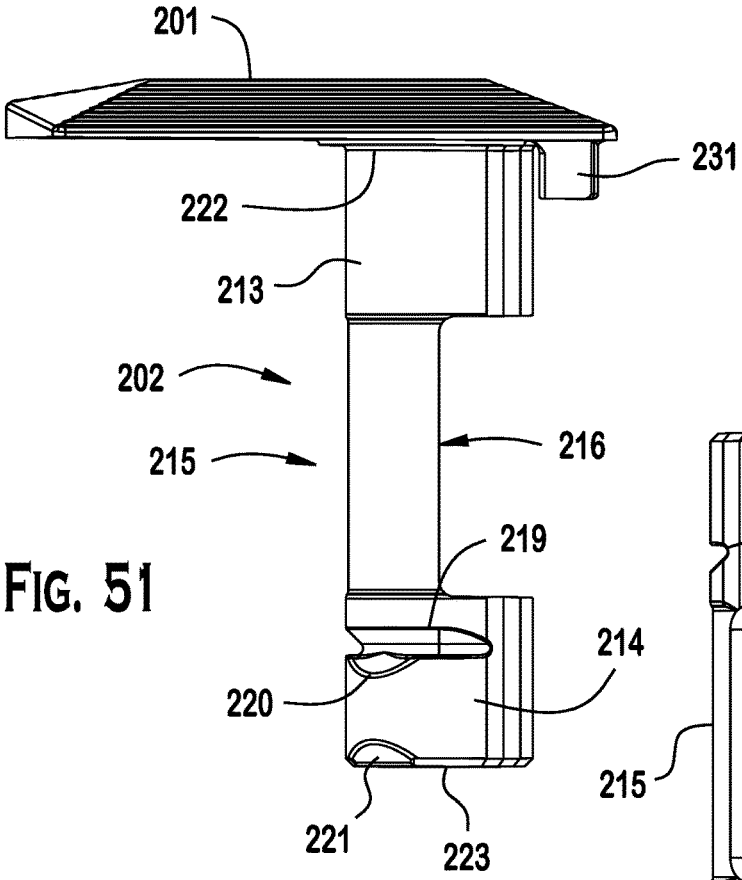
FIG. 51 is a top plan view thereof.
Figure 52:
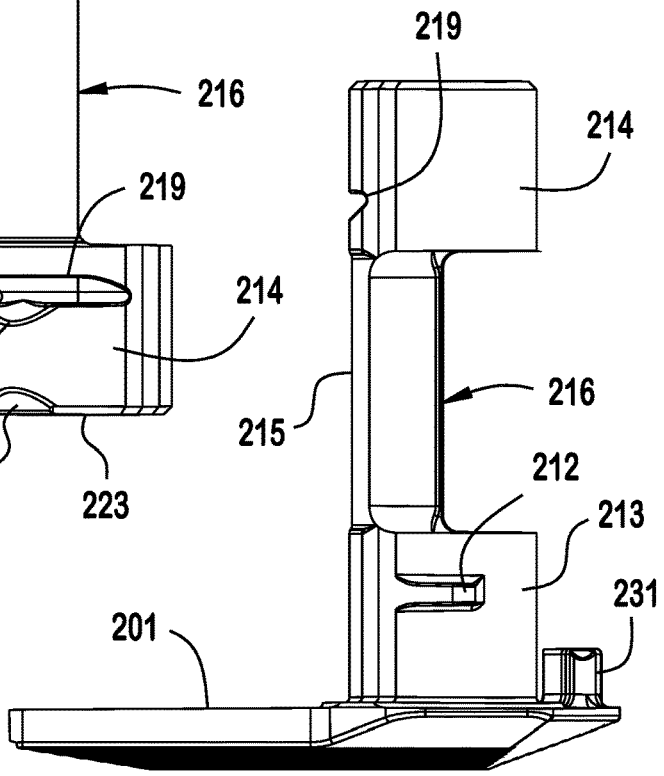
FIG. 52 is a bottom plan view thereof.
Figure 53:
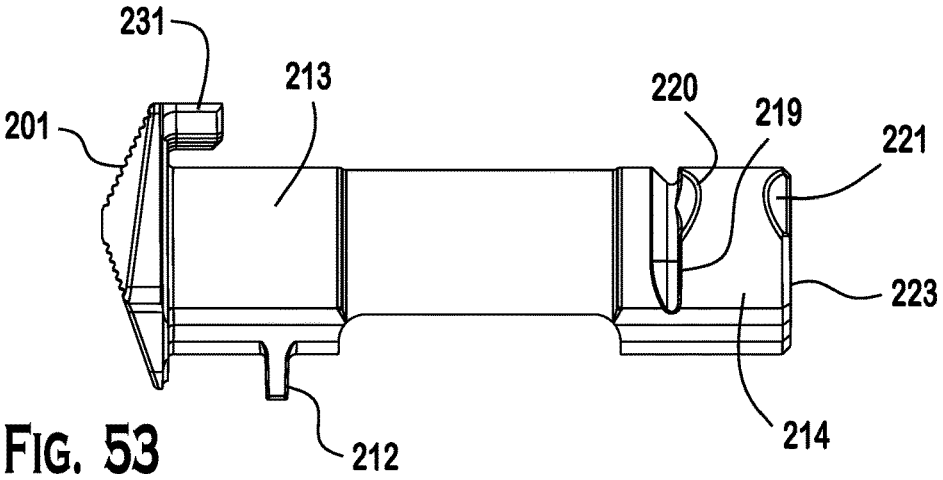
FIG. 53 is a rear view thereof.
Figure 54:
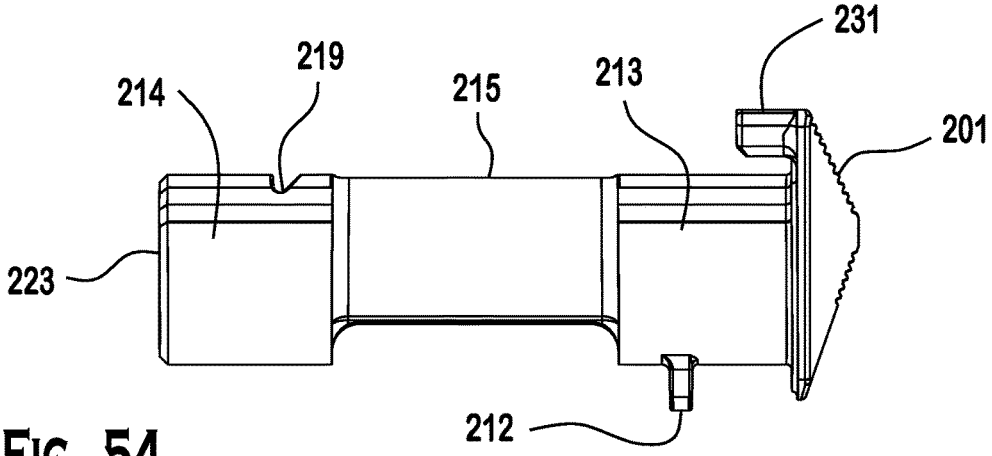
FIG. 54 is a front view thereof.
Figure 55:
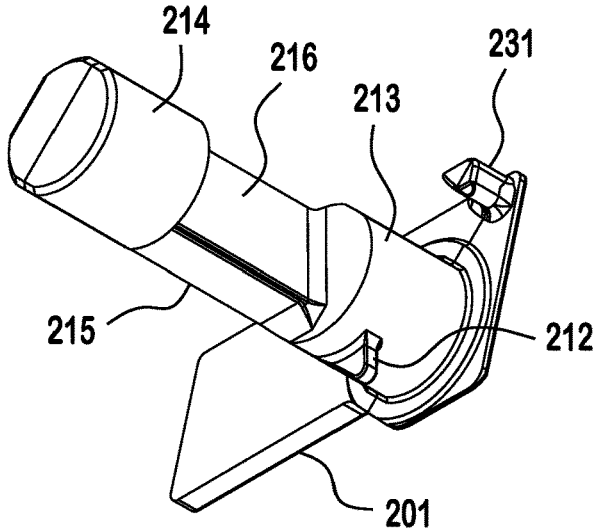
FIG. 55 is a bottom front perspective view thereof.
Figure 56:
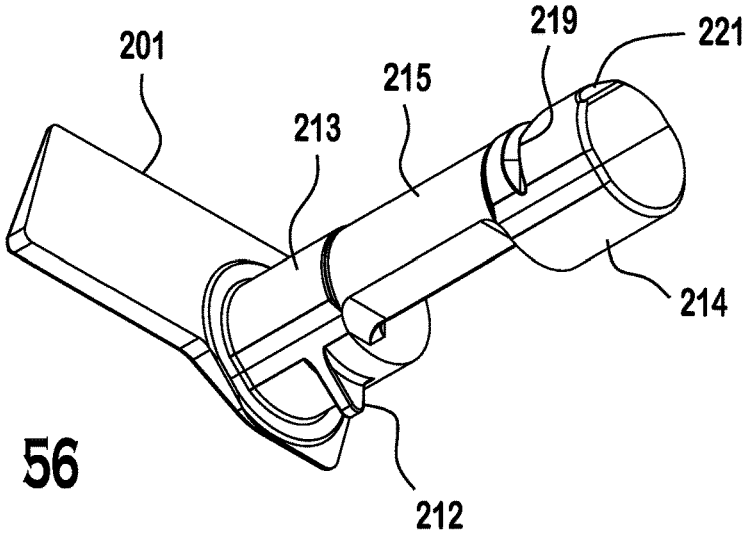
FIG. 56 is a bottom rear perspective view thereof.

Front end 121 of sear connector blocker 120 further defines a downward projecting hooked portion 127 which is configured and arranged to engage the sear connector 140 for arresting movement of the connector when not intentionally actuated via a trigger pull (e.g. dropping, jarring, or similar of the pistol 20). Sear connector blocker 120 further includes a rear facing cam surface 129 which engages front facing cam follower surface 162 formed on the front of sear connector actuator 160 (e.g. right member 160*a*) via a trigger pull for raising the sear blocker to permit release of the sear connector 140 (see also FIGS. 9 and 50). Cam surface 129 may further be engaged and actuated by a front facing cam follower surface 162 also formed on left member 160*b* of sear connector actuator 160 via operation of the pistol takedown system further described herein. In various embodiments, cam surface 129 may be flat or concavely shaped to engage cam follower surface 162 which may be convexly shaped. In one exemplary embodiment, a laterally spaced apart pair of cam surfaces 129 may be provided. The cam surfaces 129 may be formed on the rear side of lateral protrusions 130 extending outwardly from the main body of the sear connector blocker 120).

Sear connector blocker 120 is pivotably mounted to firing control housing insert 80 via a transverse mounting pin 131 which passes through lateral hole 132 formed in the main body of the blocker and defines a pivot axis. Hole 132 may be centrally located at approximately the midpoint between front and rear ends 121, 122 of sear connector blocker 120.

Figure 24:
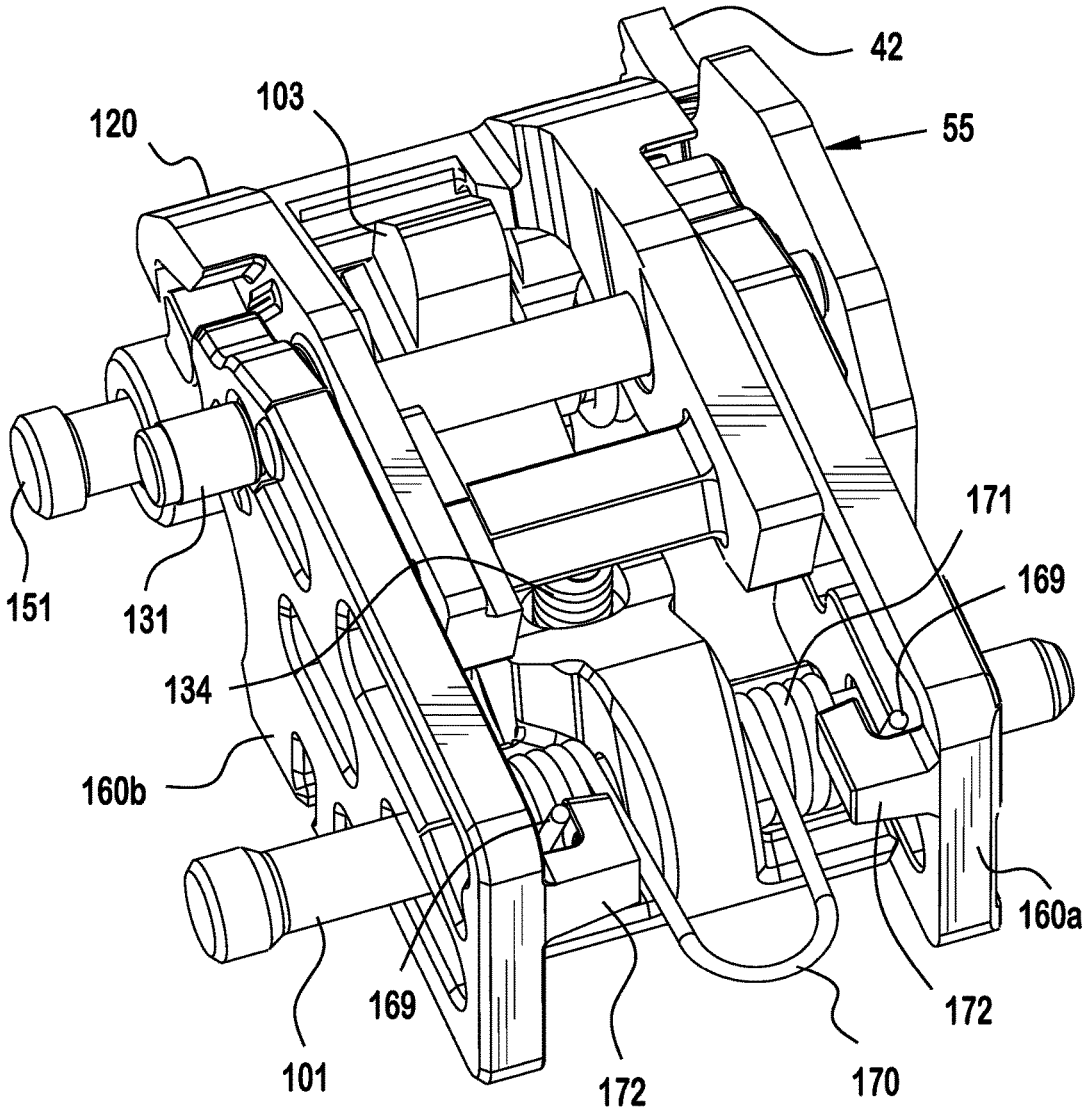
FIG. 24 is a top right perspective view of the firing mechanism of the pistol.
Figure 25:
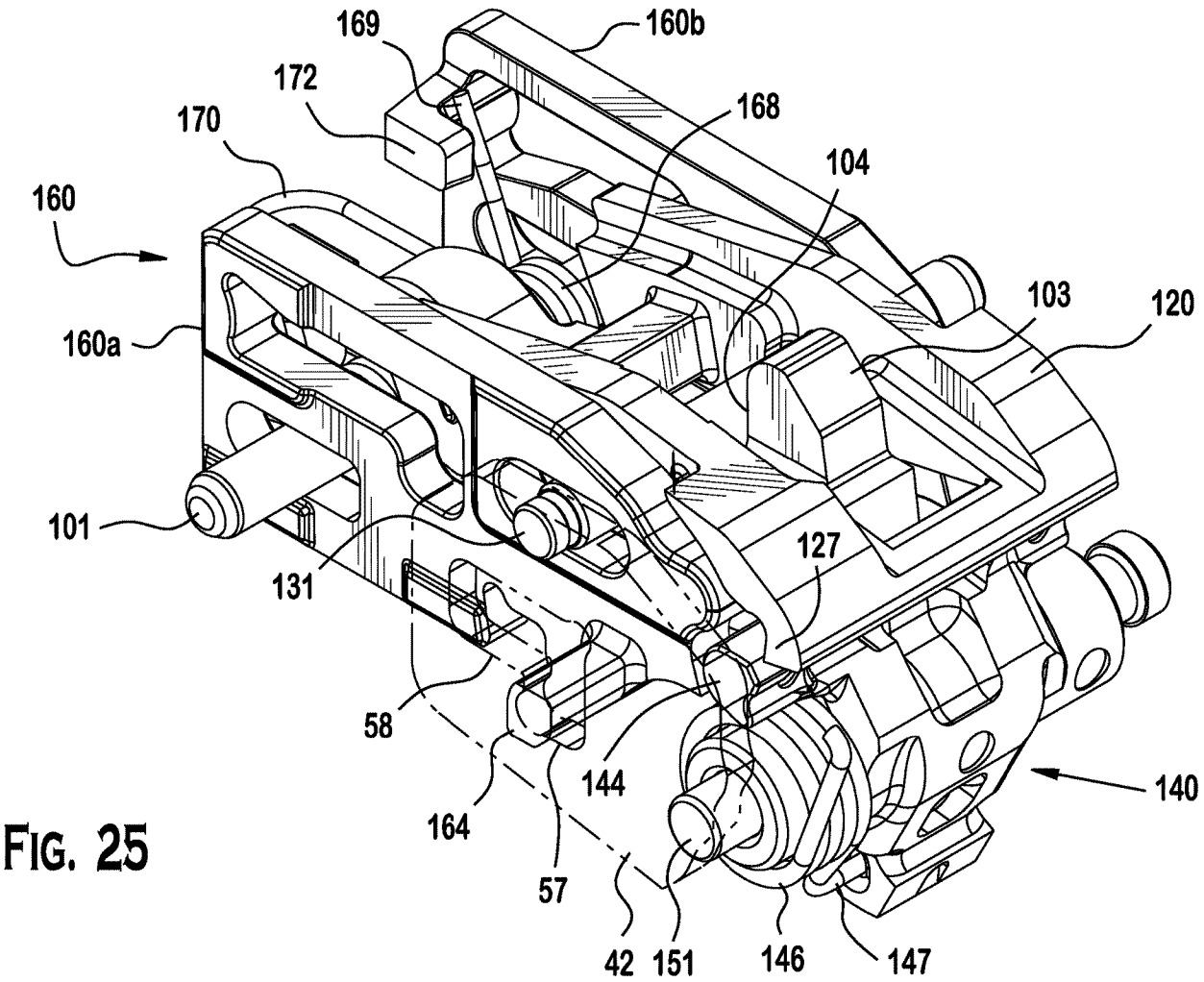
FIG. 25 is a top left perspective view thereof.

Mounting pin 131 further passes through holes 133 formed in each sidewall 82, 83 of firing control housing insert 80 and longitudinal elongated slots 163 formed in right and left members 160*a*, 160*b* of sear connector actuator 160 (see also FIGS. 24 and 59). This slotted arrangement permits longitudinal linear movement of the actuator with respect to the sear blocker mounting pin 131, firing control housing insert 80, and frame 22 in response to a trigger pull for firing the pistol 20.

Sear connector blocker 120 is pivotably movable about sear blocker pin 131 between a substantially horizontal blocking position and a tilted or angled non-blocking position. Sear connector blocker 120 is biased or urged into the blocking position by sear blocker spring 134. In the blocking position, hooked portion 127 of sear connector blocker 120 is located in the forward path of a sear connector blocking surface 143 to engage sear connector 140 and arrest its full forward pivoting motion. This prevents the sear connector 140 from rotating a sufficient amount forwarded to release the sear and discharge pistol 20.

In the tilted non-blocking position, hooked portion 127 of sear connector blocker 120 is lifted and raised out of the forward path of sear connector blocking surface 143 in response to a trigger pull. This allows the sear connector 140 to rotate forward to raise the sear and actually move the striker 65 back slightly. This positive engagement will want to reset the sear connector to its rearward resting position against the sear.

Referring to FIGS. 21-25 and 59, sear connector actuator 160 includes laterally spaced apart right and left members 160*a*, 160*b* identified above. Each member is axially elongated and generally comprises a flat plate-like body having a vertical orientation. Right and left members 160*a*, 160*b* each include a front end 165 and rear end 166.

Figure 19:
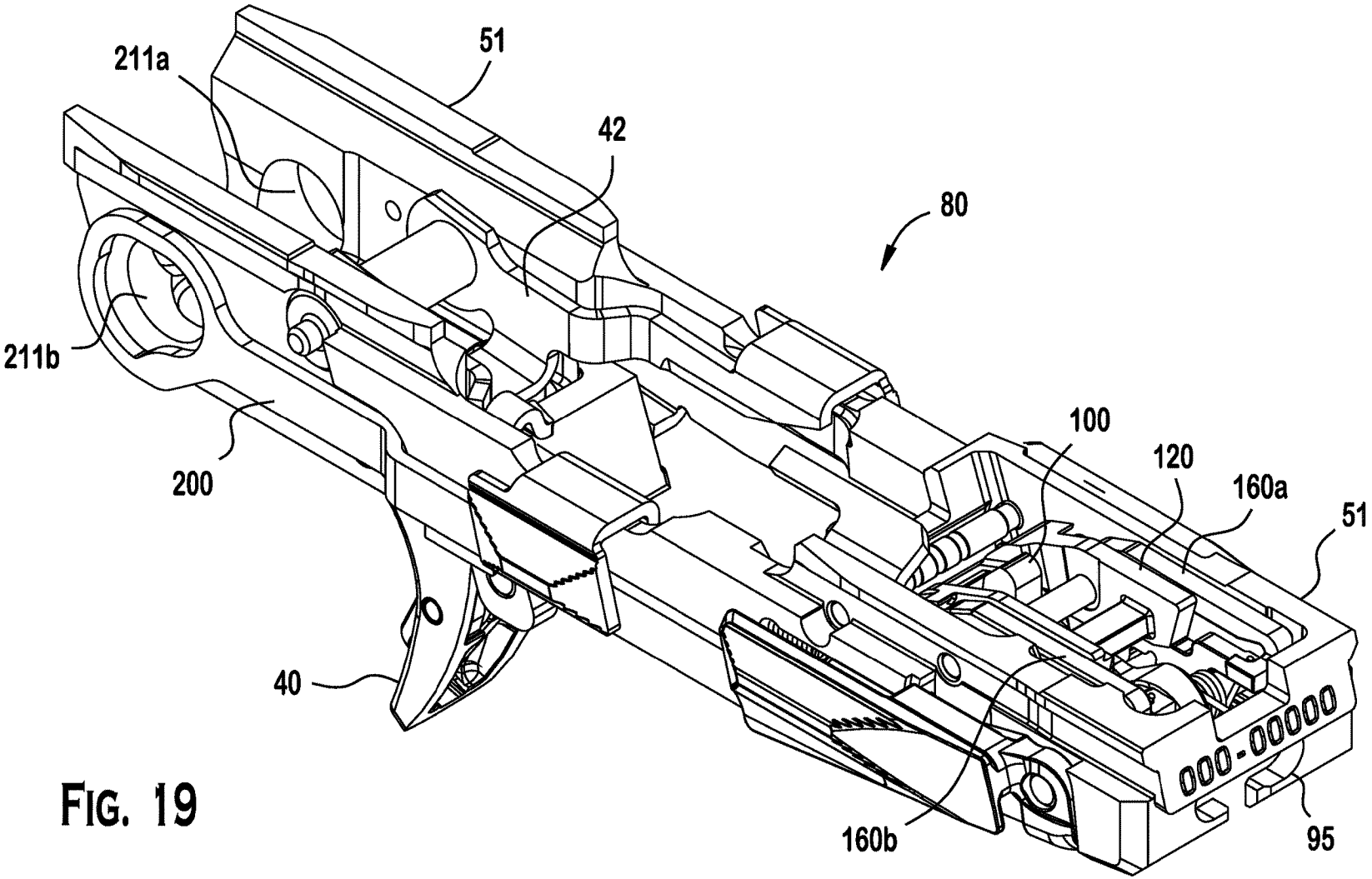
FIG. 19 is a top perspective view of the firing control housing insert including firing mechanism, trigger mechanism, and takedown lever.
Figure 20:
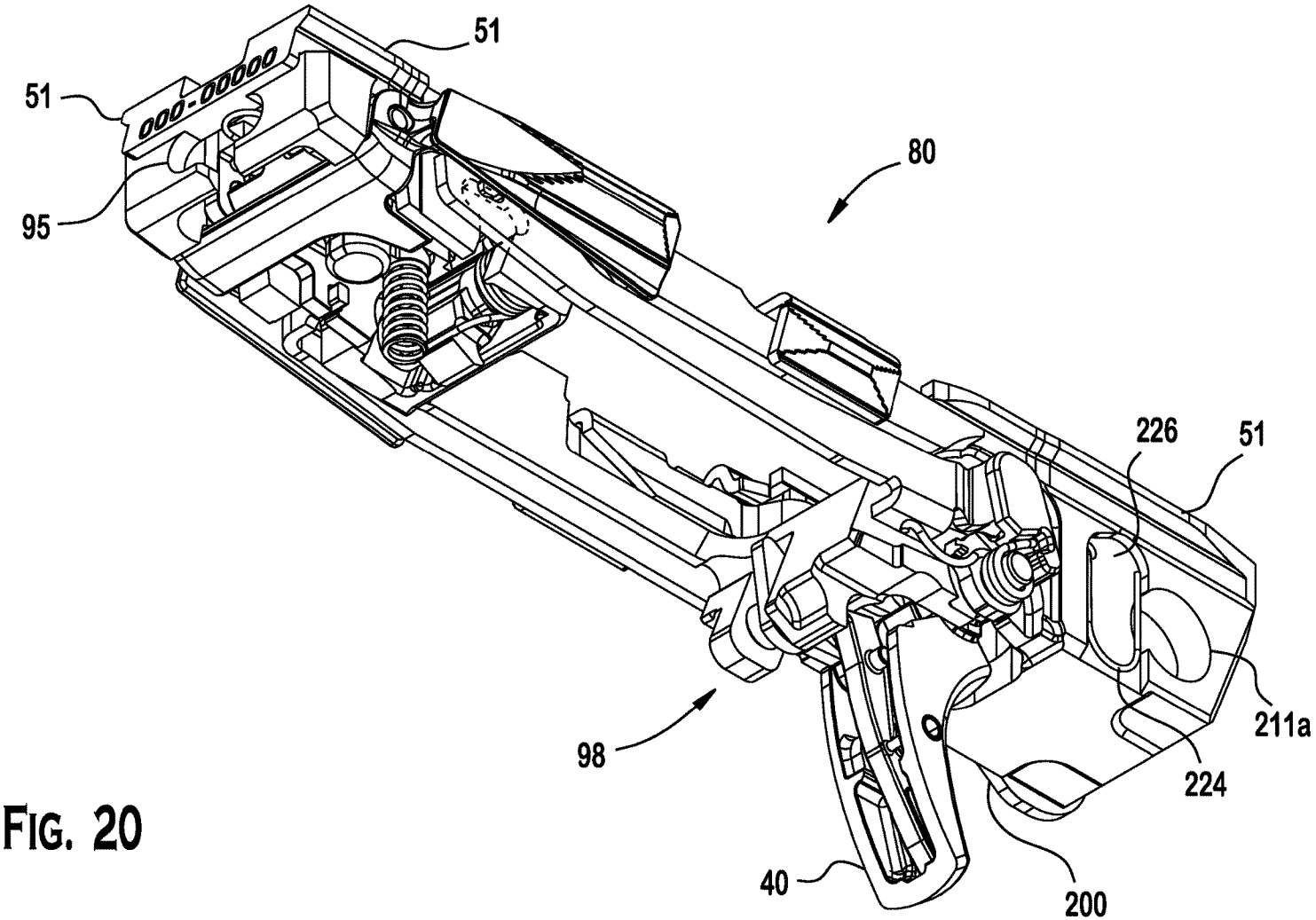
FIG. 20 is a bottom perspective view thereof.

Right member 160*a* includes a laterally extending actuating post 164 configured and arranged to engage the trigger bar 42 for slideably moving the actuator 160 forward in firing control housing insert 80. Actuating post 144 may be disposed proximate to the bottom front end 165 of the right member 160*a*. In one embodiment, actuating post 144 projects transversely outward away from longitudinal axis LA and through an axially elongated longitudinal opening or slot 88 in sidewall 82 of firing control housing insert 80 to engage the trigger bar 42 which may be mounted in frame 22 laterally adjacent and external to the firing control housing insert 80 in some configurations (see, e.g. FIG. 19). This slotted arrangement allows linear movement of the post 144 and right member 160*a* with respect to the firing control housing insert 80 in response to a trigger pull. Trigger bar 42 actuates and moves the sear connector actuator 160 via a trigger pull, as further described herein.

Right and left members 160*a*, 160*b* of sear connector actuator 160 each further include cam follower surface 162 which engages rear facing cam surface 129 of sear connector blocker 120 and a cam surface 167 which engages rear facing cam follower surface 142 of sear connector 140 (see FIG. 59). In one embodiment, cam follower surface 162 and cam surface 167 may be formed on the front ends 165 of the right and left members 160*a*, 160*b*.

In one embodiment, the right and left members 160*a*, 160*b* of sear connector actuator 160 are movable independently of each other. Accordingly, the right and left members may not be physically connected to each other in a manner in which movement of one member would cause movement of the other. Therefore, actuation of the right member 160*a* (via a trigger pull) does not actuate or move the left member 160*b* in this embodiment, and vice-versa. Left member 160*b* is a takedown actuator associated with the pistol takedown system used to disassemble the pistol, as further described herein.

A sear connector actuator spring 168 biases the right and left members 160*a*, 160*b* of sear connector actuator 160 rearwards, thereby requiring a trigger pull for axially moving trigger bar 42 forward which is turn actuates and moves the right member 160*a* forward for firing the pistol 20. Spring 168 in one exemplary embodiment may be a torsion spring including a pair of legs 169 and central loop 170 arranged to engage lateral slot 89 of firing control housing insert 80 (see, e.g. FIG. 59). Legs 169 each engage an L-shaped hook 172 formed on the inner surface of right and left members 160*a*, 160*b* of sear connector actuator 160. The action of the spring legs 169 on the hooks 172 biases the right and left members 160*a*, 160*b* rearward.

Sear connector actuator spring 168 may be mounted on sear pin 101 in one arrangement and includes a pair of spaced apart coiled sections 171 which fall on either lateral side of the sear 100. This conserves room within the firing control housing insert 80 and provides a spatially efficient arrangement. In one configuration, the sear 100 may include a pair of arcuate spring seats 113 configured for receiving coiled sections 171.

Figure 21:
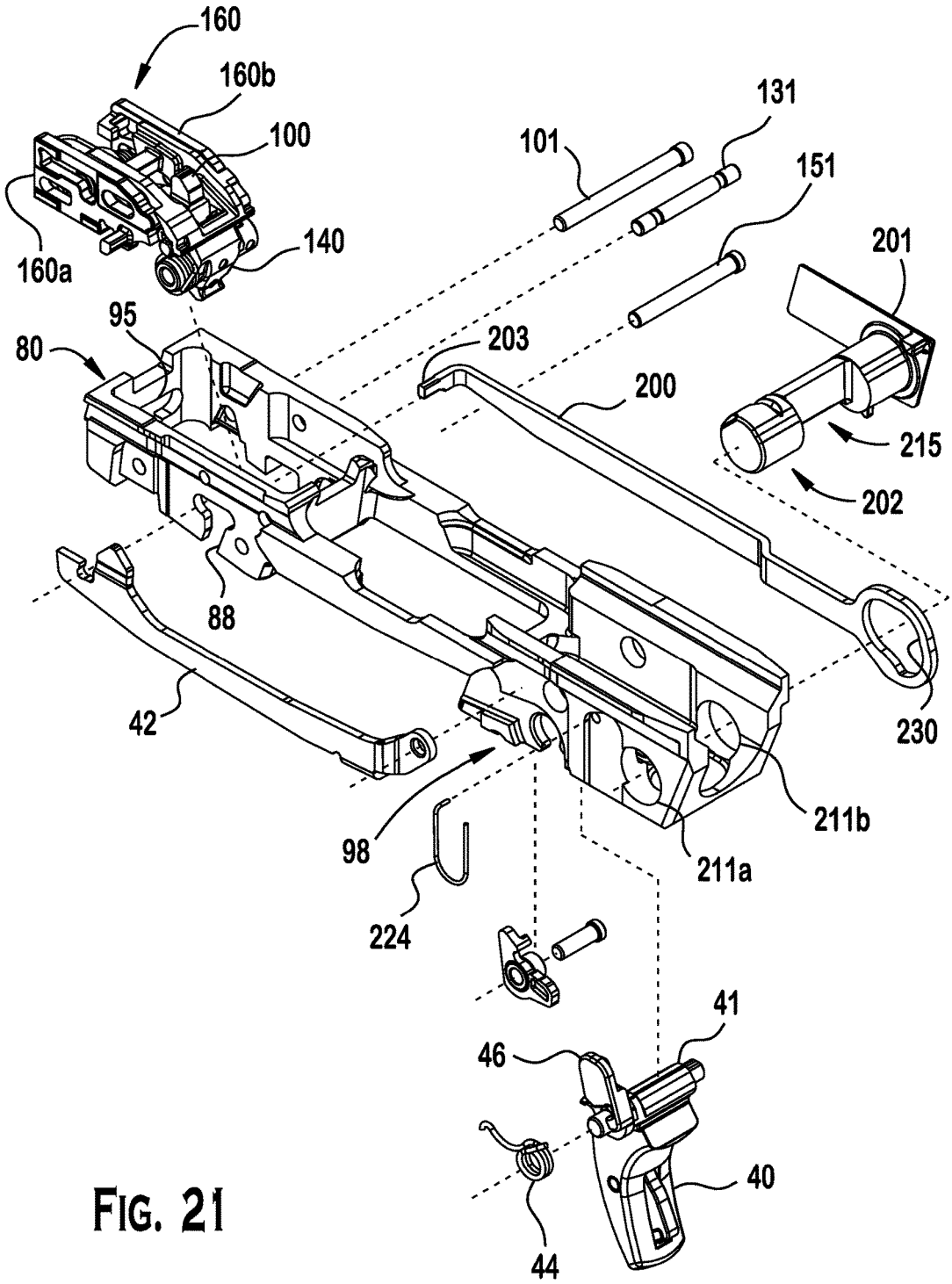
FIG. 21 is an exploded perspective view thereof.

Referring now to FIGS. 21-23, trigger bar 42 may be a generally flat and relatively thin plate-like structure having an elongated configuration and vertical orientation. In one embodiment, trigger bar 42 may include a bulbous rear end 55 which enlarged in height with respect to narrower forward portions and the front end 56 of the trigger bar. Rear end 55 defines an axially elongated operating window 67 configured to receive and engage actuating post 164 of sear connector actuator 160 therein. Forward longitudinally movement of the trigger bar 42 via a trigger pull concomitantly pulls the sear connector actuator 160 linearly forward to enable the firing mechanism. In one embodiment, operating window 67 may be generally L-shaped in configuration rotated 90 degrees counter-clockwise, as shown. Operating window 67 includes a longitudinally elongated slot portion 58 and a notched portion 57 extending downwards therefrom and in communication with portion 58. Notched portion 57 may have an axial length shorter than slot portion 58 and slightly larger than actuator post 144 to eliminate excessive play of the post within the notched portion when pulling the trigger 40. This creates positive engagement of the trigger bar 42 with the actuating post 164.

It will be appreciated that operating window 67 further interacts with actuating post 164 of sear connector actuator 160 to provide a vertical stop for limiting the upward position of trigger bar 42 under the biasing force of trigger spring 44 via the bottom surfaces of slot portion 58 and notched portion 57 of window 67 engaging the post 164 (depending on which portion the post happens to be positioned in). Other configurations of operating window 67 and trigger bar 42 are possible so long as the trigger bar functions to actuate the sear connector actuator 160 via a trigger pull.

Operation of the firing control and blocker mechanism will now be briefly described.

Starting with pistol 20 in the ready-to-fire position shown in FIG. 26, striker 65 is cocked rearwards. Referring also to FIGS. 26 and 59, sear bearing surface 68 on striker catch rail 69 is in axial alignment and engaged with striker catch surface 104 on sear 100, thereby holding the striker 65 rearward against the forward biasing force of striker spring 64. Sear connector blocker 120 is in the activated horizontal blocking position wherein a rear facing blocking surface on the hooked portion 127 of the blocker is axially aligned with and positioned to engage front facing blocking surface 143 on the sear connector 140 if the sear connector attempts to rotate forward to release the sear 100 and striker 65 somehow in the absence of a trigger pull. Trigger bar 42 is in its rearmost axial position with actuating post 164 of sear connector actuator 160 shown engaged in notched portion 57 of operating window 67. The trigger bar is in a spring-biased upward position (see, e.g. FIG. 27) with the top portion of bulbous rear end 55 seated in pocket 25 on the right side of the slide 24.

FIG. 27 shows the firing control and blocking mechanism after a trigger pull has been initiated by a user. Referring to FIGS. 27 and 59, pulling trigger 40 rearward rotates trigger pivot extension 46 (containing transverse pin 43 linking the trigger bar 42 to trigger) forward, thereby simultaneously pulling the trigger bar axially forward therewith. As trigger bar 42 moves forward, it pulls sear connector actuator 160 via actuating post 164 positioned in notched portion 57 of trigger bar operating window 67 correspondingly forward in a linear axial movement. Cam follower surface 162 on the front of the actuator 160*a* soon engages rear facing cam surface 129 of sear connector blocker 120, which has a generally angled and oblique orientation with respect to the longitudinal axis LA (axial direction) sloping downwards from rear to front. This mutual engagement raises front end 121 of sear connector blocker 120 upwards pivoting and titling the sear blocker rearwards (counter-clockwise in this figure) about pin 131 against the biasing force of and compressing spring 134. The sear connector blocker 120 thus moves to the non-blocking position, in which the rear facing blocking surface on the hooked portion 127 of the blocker is moved above and no longer axially aligned with and positioned to engage front facing blocking surface 143 on the sear connector 140. The blocker safety mechanism is now disabled. Continued pulling of the trigger 40 causes the actuator cam follower surface 162 to maintain contact with and slide downwards along sear blocker cam surface 129.

Figure 15:
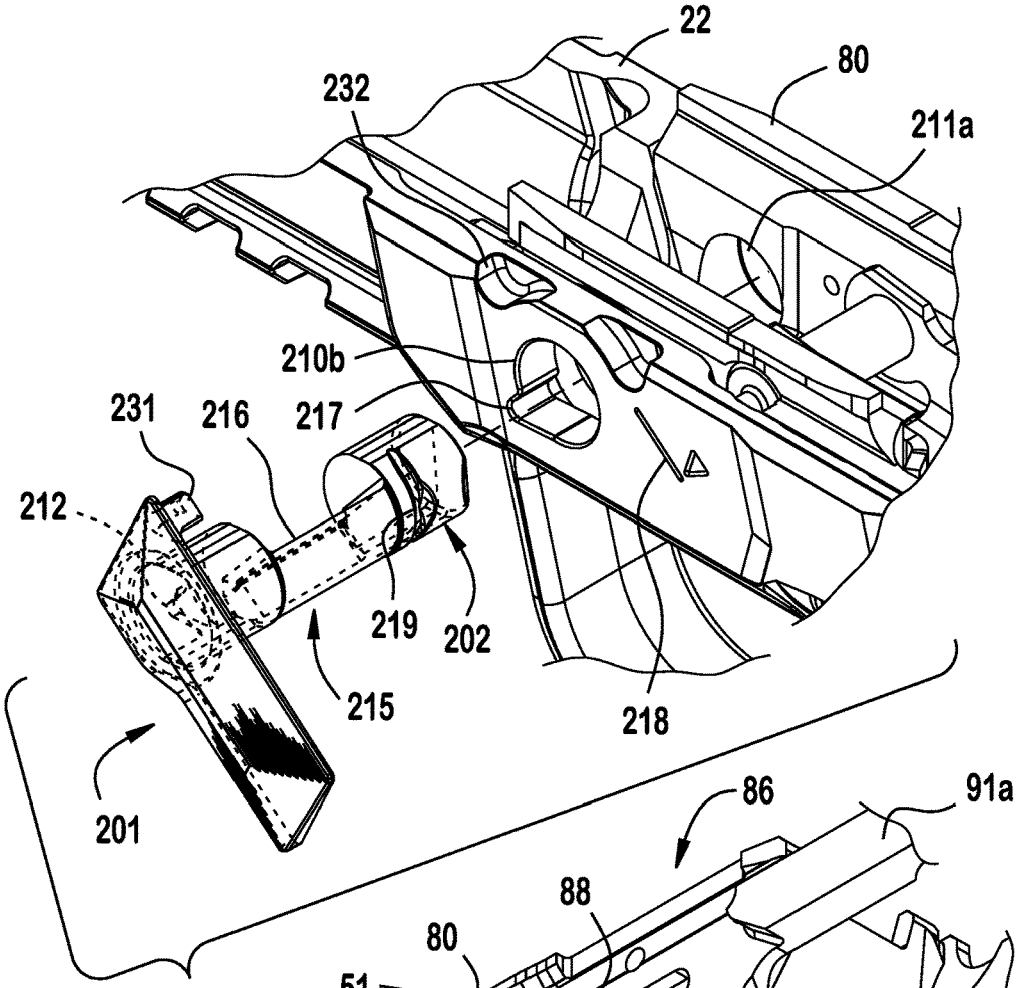
FIG. 15 is an exploded perspective view showing the takedown pin removed from the frame and firing control housing insert.
Figure 17:
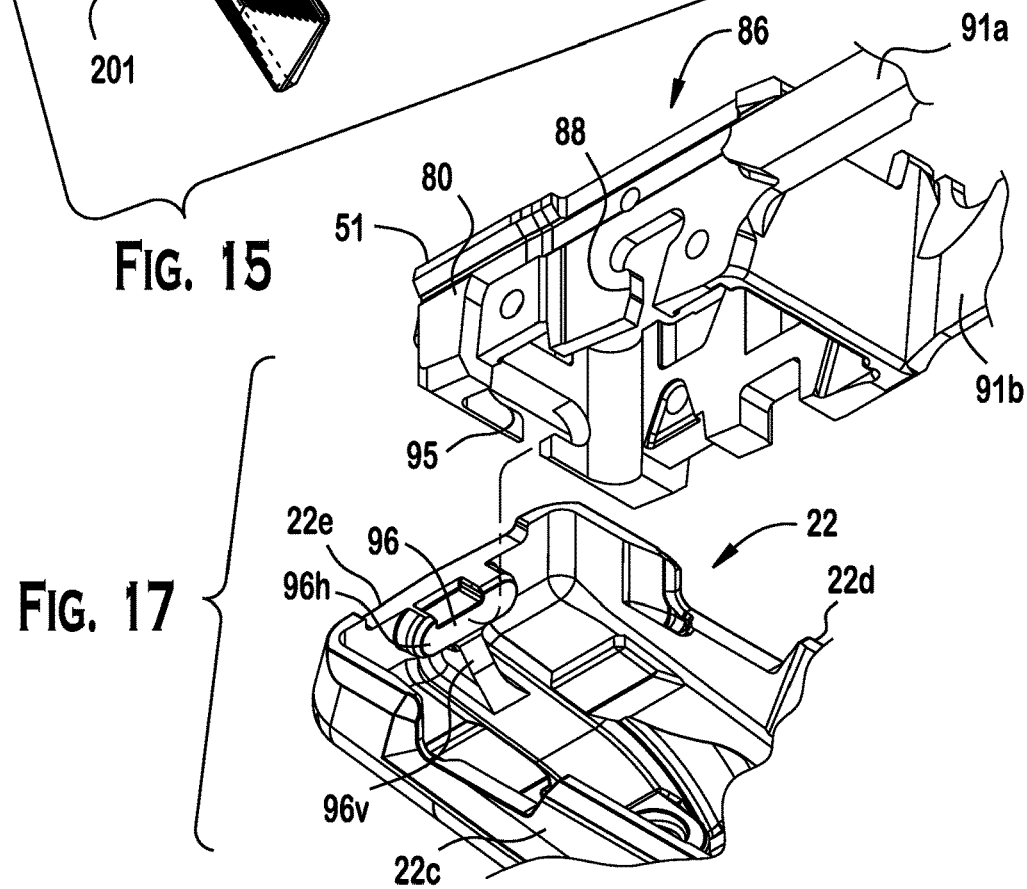
FIG. 17 is an exploded perspective view showing rear securement features of the rear portions of the firing control housing insert and frame.
Figure 16:
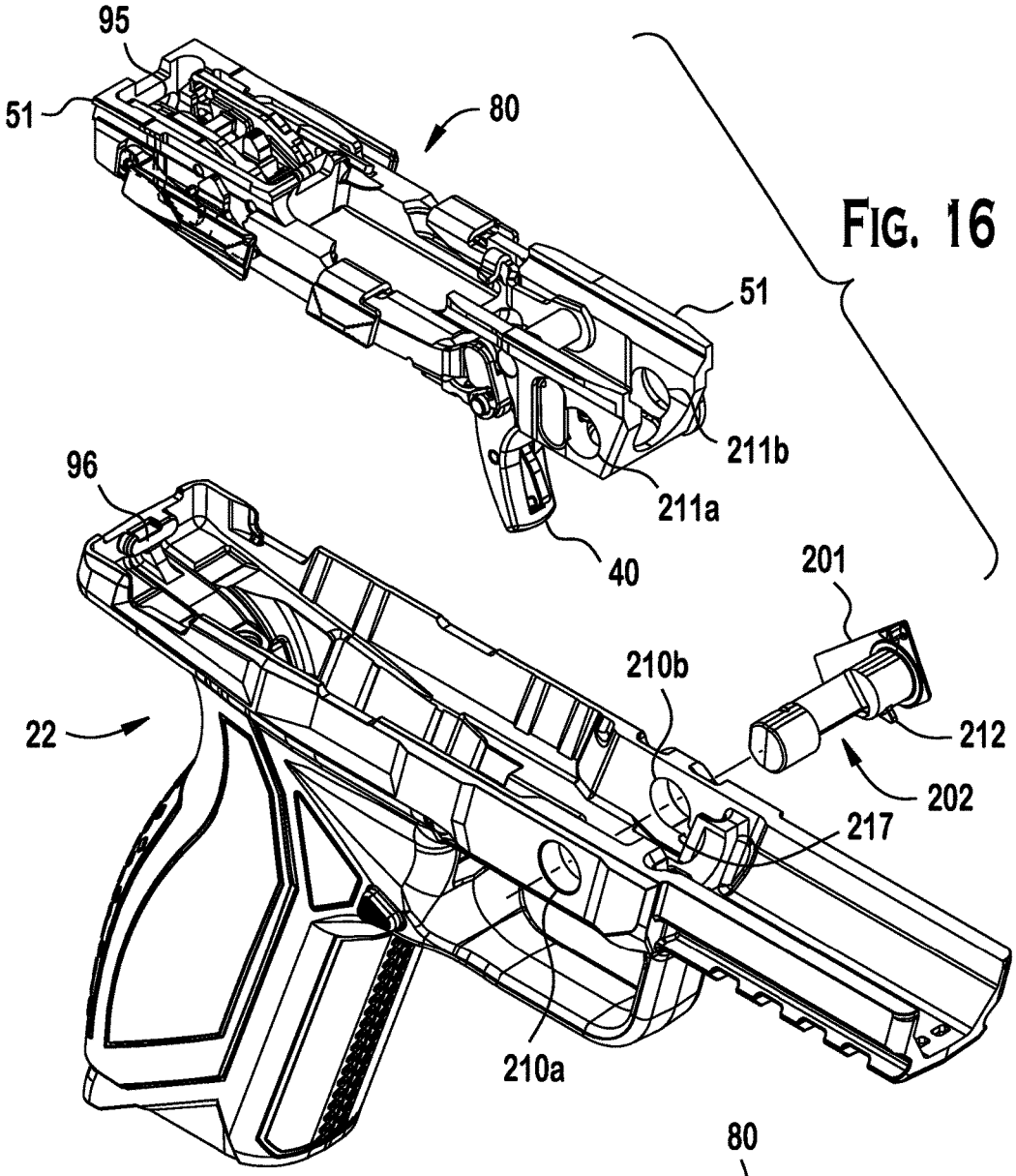
FIG. 16 is an exploded perspective view showing the takedown pin and firing control housing insert removed from the frame.

Cam surface 167 of sear connector actuator 160*a* continues to be pulled forward by trigger bar 42 with the trigger pull and eventually engages rear facing cam follower surface 142 of sear connector 140. In one embodiment, this occurs immediately after sear connector blocker 120 has been moved to the non-blocking position by sear connector actuator 160 (described above), which now will further act to rotate and actuate the sear connector 140 while simultaneously holding the sear blocker in the non-blocking position. As trigger 40 continues to be pulled rearward, the sear connector actuator 160 moves axially forward continuing to rotate the sear connector blocker 120 up and forward out of the way. Sear connector actuator 160 is now rotating the sear connector 140 forward and downward out from under the sear 100, thereby further tensioning sear connector spring 146. The sear 100 rises slightly during this motion to push back the striker 65 slightly as the sear connector 140 rotates which is caused by engagement between sear connector latching surface 145 and sear latching edge 112 as shown in FIG. 15 (see directional arrows). This further compresses the striker spring 64 providing the heavier second stage trigger load which is felt by the user as increased resistance at the trigger 40 transmitted via the firing control and trigger linkage. FIG. 15 shows the sear connector 140 and sear 100 at the takeoff point immediately before engagement between these components is broken to fire the pistol 20 (note position of latching edge 112 on edge of latching surface 145).

Sear connector actuator 160 continues to push and rotate the sear connector 140 forward and downward to break contact between the sear connector and sear 100 as shown. Without support from sear connector 140, sear 100 now rotates forward and downward under the forward biasing force of striker spring 64 and contact between sear bearing surface 68 of striker 65 and striker catch surface 104 (i.e. convex camming portion 114) of sear 100 is broken, as described elsewhere herein. Sear spring 107 is compressed downwards in the process. Striker 65 is thus released from the sear 100 and travels axially forward rapidly to strike and detonate a chambered cartridge C, thereby discharging the pistol 20. Striker catch surface 104 on upward catch protrusion 103 of sear 100 slides from angled sear bearing surface 68 on striker 65 down onto and along cam track 70 on the bottom surface of the striker catch rail 69. The sear striker catch surface 104 maintains contact with and slides rearwards along cam track 70 which acts to hold the sear 100 in the downward position as the striker 65 moves forward. The striker catch rail 69 defining cam track 70 thereon has a sufficient axial length to hold the sear 100 down at least until the striker reaches and strikes the chambered cartridge.

After pistol 20 has been discharged, the slide 24 travels rearward under recoil to a point where catch rail 69 of striker 65 (mounted in the slide) breaks contact with the sear 100. The sear 100 now is free to rotate upward and rearward under expansion of the sear spring 107 thereby returning the sear to its former upright position. The sear 100 upward rotation is stopped by contact with the sear blocker pivot pin 131. Once sear 100 rotates up, the sear connector 140 is also able to rotate back under and engage sear latching edge 112 due to relaxation of sear connector spring 146. Once sear connector 140 is back against and re-engages sear 100, sear connector blocker 120 is able to rotate back down to the blocking position as sear blocker spring 134 expands and reset itself to prevent sear connector rotation. Sear bearing surface 68 of striker 65 reengages striker catch surface 104 of sear 100. The striker firing mechanism is now re-cocked and reset as shown. In one embodiment the sear spring 107 may typically have a higher force than the blocker spring 134 although in some embodiments spring 134 could be stronger in theory, but in practice it is not needed. This is where the uniqueness of the present invention comes into play. The sear in its upmost position (against sear blocker pivot pin 131) is going to compress blocker spring 134 due to the arrangement where one end of spring 134 rests in the pocket of the sear. So the upward motion of the sear is always going to compress spring 134 and increase the force on the back of the blocker, which is going to want to force it down into its blocking position. So if the pistol is dropped in a manner that wants the sear to move up against sear blocker pin 131 due to inertial effects (noting that the sear is not balanced), the effect would be to force the blocker 120 down against sear connector actuator 160*a* with more force, thereby keeping 160*a* from being able to rotate out from under and releasing the sear.

It should be noted that the rearward motion of the slide 24 under recoil described above also moves the trigger bar 42 from the upward position (see, e.g. FIG. 27) to the downward position (see, e.g. FIG. 26). As slide 24 moves rearward, top portion of bulbous rear end 55 of trigger bar 42 leaves pocket 25 and is engaged by the right bottom surface 27 of slide 24 which pushes the trigger bar down. This causes actuating post 164 of sear connector actuator 160 to leave the trigger bar operating window notched portion 57 and travel upwards into and rearward in slotted portion 58 as shown in FIG. 21 (as the user still pulls the trigger rearward to a full trigger pull position thereby moving the trigger bar the maximum distance forward and conversely post 164 rearward in slotted portion 58 to the position illustrated in this figure). In one embodiment, the top portion of trigger bar bulbous rear end 55 may include a forward downward sloping rounded surface to provide a smooth transition for the trigger bar to leave pocket 25 and engage slide right bottom surface 27 to avoid hang-ups. The slide right bottom surface 27 in the front of pocket 25 may further have an upward and rearward angled mating surface to further ease the transitory motion. The rear angled surface of pocket 25 is intended to push the trigger bar 42 down when disassembling the slide 24 from the pistol 20 and does not have any bearing on the actual firing other than it is far enough back to allow the trigger bar to achieve its maximum height.

Slide 24 continues to travel rearward under recoil and eventually stops its rearward motion. The slide is then returned fully forwarded into battery with the rear end of barrel 26 by recoil spring 29 (shown in FIG. 2), which recloses the breech area. The user next releases the trigger 40 which moves fully forward thereby in turn pushing the trigger bar rearward. Actuating post 164 of sear connector actuator 160 moves forward in slotted portion 58 of trigger bar operating window 67 during this motion. Once the trigger bar moves rearward enough, the notched portion 57 of operating window 67 vertically aligns with post 164 now located above the notched portion. The trigger bar 42 is then able to pop back up due to the biasing action and torque of the trigger bar spring 44. The trigger bar 42 rotates up once its rearward motion is sufficient for slot 58 of the trigger bar to slide to the rear of post 164 and notched portion 57 gives room for the trigger bar to rotate up. This rotating up of the trigger bar 42 re-engages the trigger bar notched portion 57 with post 164. The trigger mechanism is now fully reset and the pistol firing control mechanism is returned to the ready-to-fire position shown in FIG. 26. Pistol 20 is now readied for firing the next round.

Fire Control Housing Insert

The firing control housing insert 80 will now be further described. Referring initially to FIGS. 21 and 34-41, firing control housing insert 80 has an elongated body extending axially in the direction of the longitudinal axis LA. Insert 80 includes an interior 93, exterior 94, a rear portion 86 defining a rear end 97 and rear wall 81, front portion 87 defining a front end 89, and two opposing spaced apart right and left sidewalls 82, 83 extending longitudinally and axially between the front and rear ends. An interior space 84 formed in the insert is configured and dimensioned for housing and supporting the firing control components including the trigger group further described above. The top and bottom 85, 90 of the insert 80 may be at least partially open in one embodiment for the firing control and trigger components. The firing control housing insert 80 is configured and dimensioned for insertion into and removable coupling inside axial cavity 22*b* of frame 22 via a mounting system further described herein. When mounted, the firing control housing insert 80 extends from the rear end 22*e* of frame 22 to the front of the curved frame trigger guard enclosing the trigger 40 on the bottom of the frame.

The front end 89 may be axially open in one embodiment and supports the trigger 40 and related components (reference FIGS. 19-23). Front portion 87 may be generally U-shaped in transverse cross section in one configuration with an at least partially closed bottom 90; however, other cross-sectional shapes may be used. In other embodiments, the bottom 90 may be completely open in the front portion. A trigger mounting section 98 is formed on the front portion 87 which supports and pivotably mounts the trigger 40 via pivot pin 41 and related components directly to the firing control housing insert 80. Section 98 may include a downwardly open arcuately rounded slot for receiving the transverse trigger pivot pin.

The front portion 87 is connected to the rear portion 86 by a pair of laterally spaced apart struts 91*a*, 91*b*. Struts 91*a*, 91*b* may have a smaller profile and height than the front and rear portions 87, 86. A central opening 92 is defined between the struts which provides space for uploading a cartridge from the magazine 50 into the action. In one implementation, the front portion 87 defines one opposing pair of slide longitudinal support rails 51 and rear portion 86 defines another opposing pair of longitudinal support rails 51. The rails slideably engage mating grooves 52 formed in the slide for reciprocating forward/rearward motion, as already described.

Firing control housing insert 80 may be made of any suitable metallic or non-metallic material suitable for stably and movably supporting the firing control components without failure after repeated firing of the pistol 20. In one exemplary embodiment, the insert may be made of metal such as without limitation aluminum, steel, titanium, or other. Examples of non-metallic materials that may be used includes glass reinforced or unreinforced polymers and composites. The frame 22 may be made of similar metal or non-metallic materials. In one implementation, the insert 80 is made of metal and the frame 22 is made of a non-metallic material such as a polymer.

The mounting system used to detachably couple the firing control housing insert 80 in frame 22 includes front and rear securement features. Referring generally now to FIGS. 5-18 and 32-56, the rear securement feature comprises a T-shaped locking slot 95 formed in rear wall 81 of the insert that receives a corresponding T-shaped locking protrusion 96 formed in the rear wall 96 of frame 22. Protrusion 96 is formed within the axial cavity 22*b* of the frame and projects axially forward from the rear wall 96. Slot 95 includes a horizontal section 95*h* and vertical section 95*v*. Protrusion 96 includes a horizontal section 96*h* and vertical section 96*v*. In some alternative configurations, the vertical sections 95*v*, 96*v* of the slot and protrusion respectively may be omitted.

The front securement feature comprises transverse takedown pin 202 and operating lever 201 assembly. Pin 202 is insertably received through two laterally spaced apart right and left mounting holes 210*a* and 210*b* in grip frame 22. The pin 202 is further received through two laterally spaced apart right and left mounting holes 211*a* and 211*b* formed in firing control housing insert 80 positioned inside of holes 210*a*, 210*b* in the grip frame. Holes 210*a*, 210*b*, 211*a*, and 211*b* are concentrically aligned. Operating lever 201 is axially elongated in the direction of and parallel to the longitudinal axis LA when the lever is in the normal horizontal operating position (see, e.g. FIG. 5). When mounted in the grip frame 22, the lever 201 is disposed on the exterior of the frame for ready access to a user for operating the lever.

Referring to FIGS. 47-56, the takedown pin 202 is generally cylindrical in shape and comprises a first end portion 213 and end 222 disposed proximate to and coupled with operating lever 201, and opposite second end portion 214 and free 223 distal to the operating lever, and a reduced diameter middle portion 215 extending therebetween. Middle portion 215 includes a flat bypass surface 216 which functions to allow removal of the slide from the firearm. When the takedown operating lever 201 and pin 202 assembly is rotated into a vertical takedown position, the pin 202 is in a bypass position so that the camming lug 241 on the bottom of the barrel (FIG. 2) can slide forward past and over the bypass surface 216 which is oriented horizontally. The takedown assembly may therefore be considered to be in an unlocked slide position. When the operating lever and pin assembly is rotated into a horizontal ready-to-fire position, the bypass surface 216 is oriented in a vertical blocking position. The arcuately curved rear side of the pin 202 opposite the bypass surface blocks the forward path of the barrel camming lug 241 to prevent moving the slide 24 forward enough for removal from the frame 22. The takedown assembly may therefore be considered to be in a locked slide position.

To create an upward limit stop for maintaining the lever 201 in the horizontal normal operating position (see, e.g. FIG. 5), an inwardly extending limit tab 231 is formed on the lever and positioned at least partially above takedown pin 202. Tab 231 is positioned near the front of operating lever 201 and engages an upwardly open pocket 232 (see, e.g. FIGS. 43 and 46) formed in the pistol grip frame 22. When the takedown pin 202 is rotated counter-clockwise from the removal position shown in FIG. 10 (operating lever 201 obliquely angled downwards) to the operating or ready-to-fire position shown in FIG. 5 (lever 201 horizontal), the limit tab 231 enters the pocket 232 from above the frame so that the lever 201 cannot be rotated farther past the horizontal position (see, e.g. FIG. 6). When the lever 201 is rotated clockwise from this horizontal position back into the obliquely angled takedown position shown in FIG. 10, the tab 231 moves upward out of pocket 232 and is positioned slightly above the top of frame 22 (see, e.g. FIG. 11). This is only possible when the slide 24 is moved to the rear of the frame. When the slide is in the forward ready-to-fire position shown in FIG. 1, the left peripheral underside surface 240 of the slide (see, e.g. FIG. 2) blocks the tab 231 from leaving pocket 232 in the frame. Accordingly, the limit tab 231 has dual functionality associated with the takedown pin 202 as both a rotational limit and blocking stop.

Figures 57, 58:
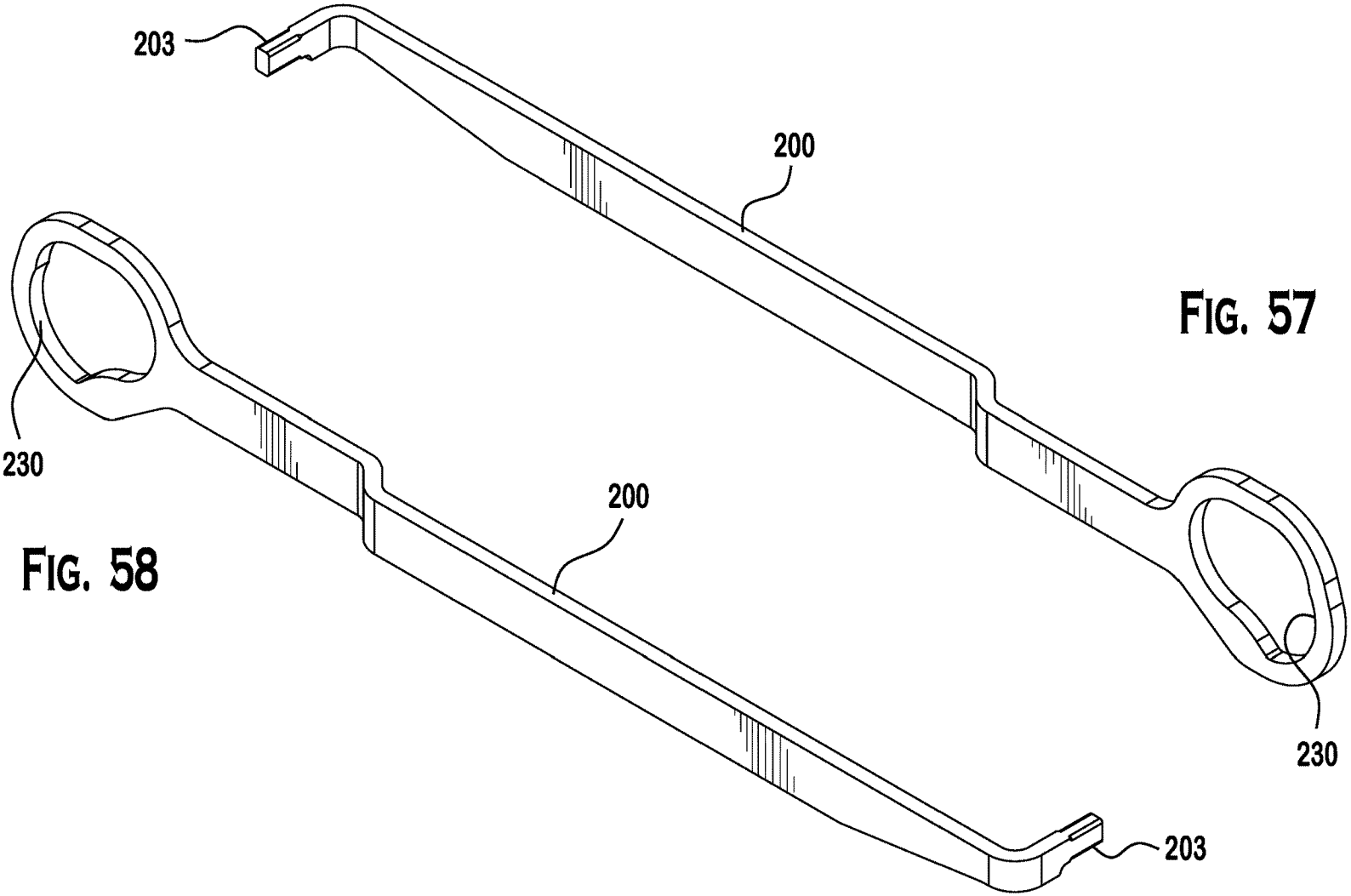
FIG. 57 is a right side perspective view of the takedown bar.
FIG. 58 is a left side perspective view thereof.

The takedown pin 202 assembly includes two interlock features which prevent removal of the pin from the pistol 20. A first interlock feature is associated with the left operating lever side of the takedown pin and left mounting hole **210*b* in the frame. A retention member which in one non-limiting embodiment may be cam follower protrusion 212 that extends radially outwards from the first end portion 213 of takedown pin 202 to operably interact with a complementary shaped removal aperture 217 formed in left sidewall 22*d* of grip frame 22. Cam follower protrusion 212 may be generally triangular-shaped and have a tip or end that is arcuately curved and rounded as shown to define a follower surface which slidingly engages a mating cam 230 formed on the front end of takedown bar 200 as further described herein (see, e.g. FIGS. 57-58). The protrusion 212 is spaced laterally inward from the operating lever 201 by a distance sufficient to allow the frame 22 to be interposed between the protrusion and lever. Aperture 217 communicates with and opens into mounting hole 210*b* giving the hole an asymmetrical shape about a vertical hole centerline (see, e.g. FIG. 43). Aperture 217 may therefore be arranged along a perimeter of hole 210*b* as shown. Protrusion 212 is disposed between left sidewalls of the frame 22 and firing control housing insert 80 when the takedown pin 202 is fully mounted in the pistol 20. The cam follower protrusion 212 prevents lateral removal of the takedown pin 202 through the mounting hole 210*b* in frame 22 except for when the protrusion is rotated to a removal position transversely aligned with the removal aperture 217 in the frame. In all other positions, cam follower protrusion 212 is trapped between and would engage the interior surface of frame sidewall 22*d* to prevent sliding the pin out of mounting hole 210*b* (see, e.g. FIGS. 5 and 6**).

In one embodiment, an alignment mark or indicia 218 may be provided on the exterior surface of the grip frame 22 proximate to the left mounting hole **210*b* to guide a user in rotating the takedown pin 202 to the removal position since the operating lever 201 visually obscures the location of the hole. The user aligns one of the two long edges of the operating lever with indicia 218 which aligns removal aperture 217 and cam follower protrusion 212 to remove the takedown pin 202 from the pistol (see, e.g. FIGS. 10 and 11). In one embodiment, the operating lever is placed in approximately a 45 degree downward position obliquely angled with respect to longitudinal axis LA of pistol 20 which aligns the cam follower protrusion 212 with removal aperture 217. The aperture 217 may be located at the bottom of the mounting hole 210*b* in such an arrangement (e.g. about 8 o'clock position in FIG. 6). In the normal operating position, the operating lever 201** of the takedown pin is oriented horizontal and parallel to longitudinal axis LA of the pistol.

Figure 29:
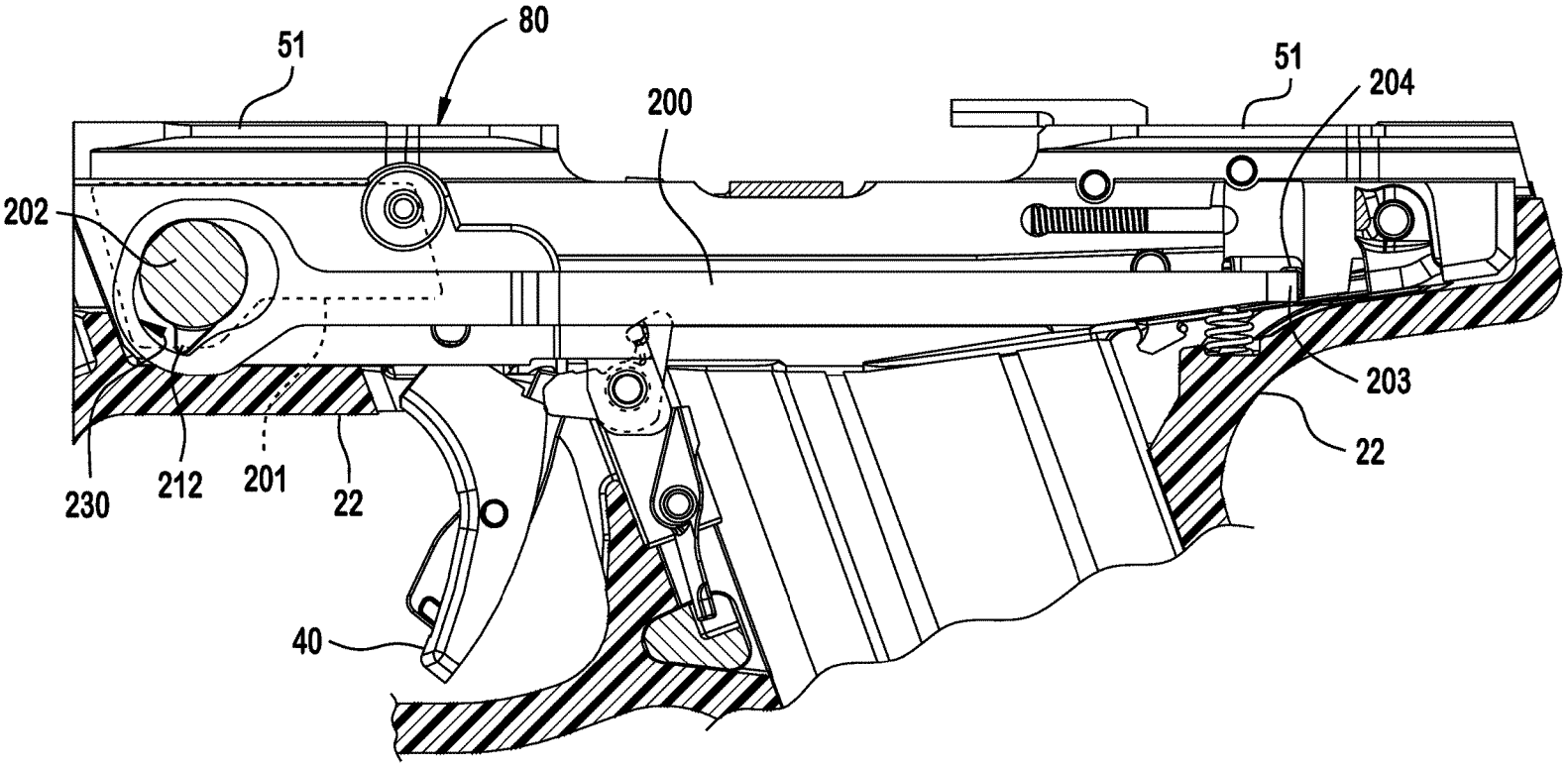
FIG. 29 is a left side view thereof.
Figure 30:
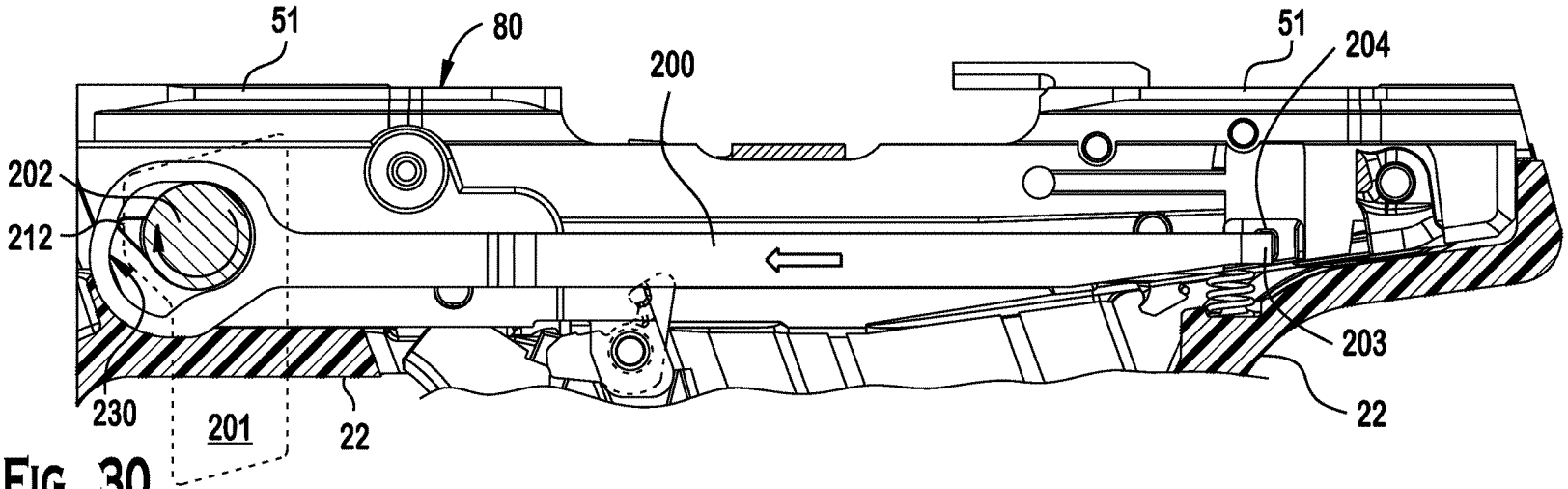
FIGS. 30 and 31 are left side views thereof showing the takedown bar and takedown pin in first and second rotational operating positions respectively.
Figure 31:
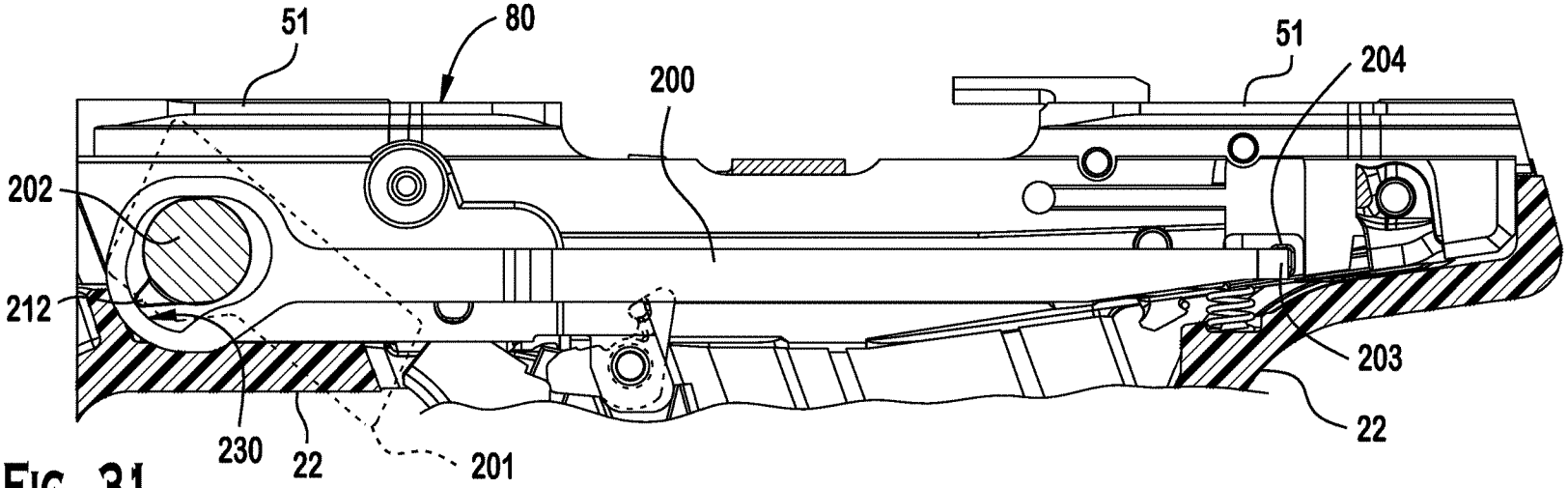
Figures 32, 33:
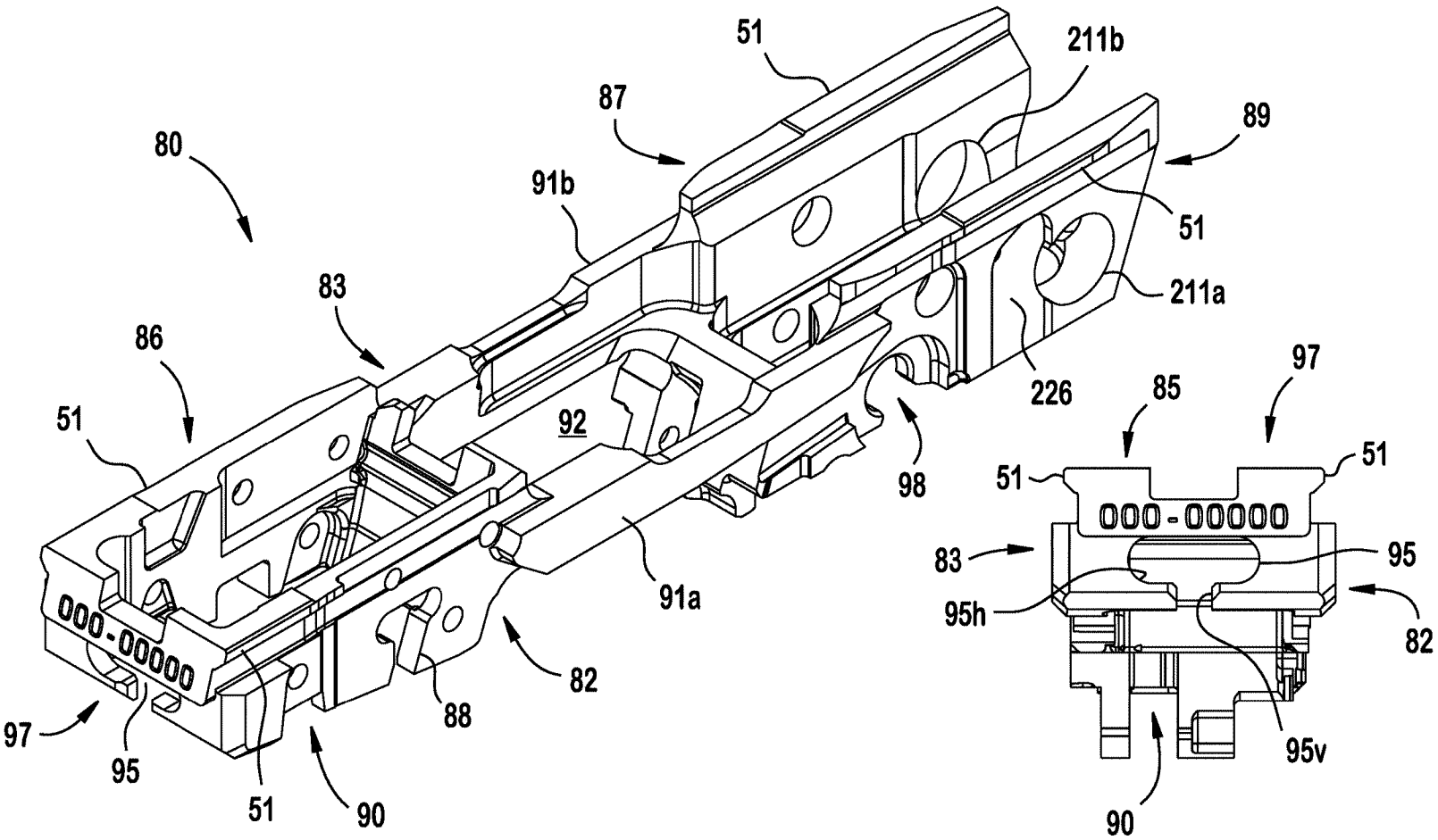
FIG. 32 is a top right perspective view of the firing control housing insert.
FIG. 33 is a rear end view thereof.
Figures 34, 35:
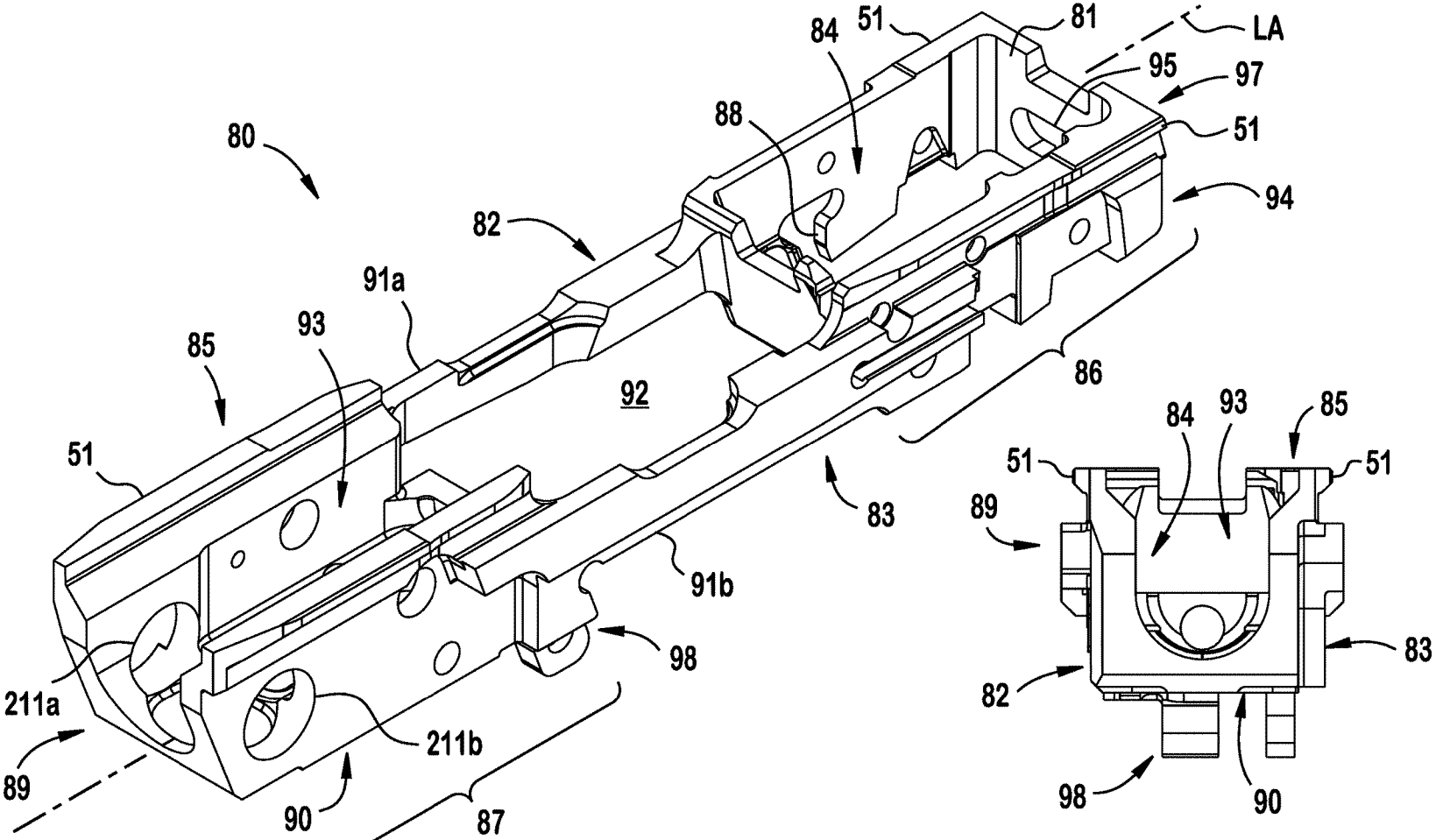
FIG. 34 is a top left perspective view thereof.
FIG. 35 is a front end view thereof.
Figure 36:
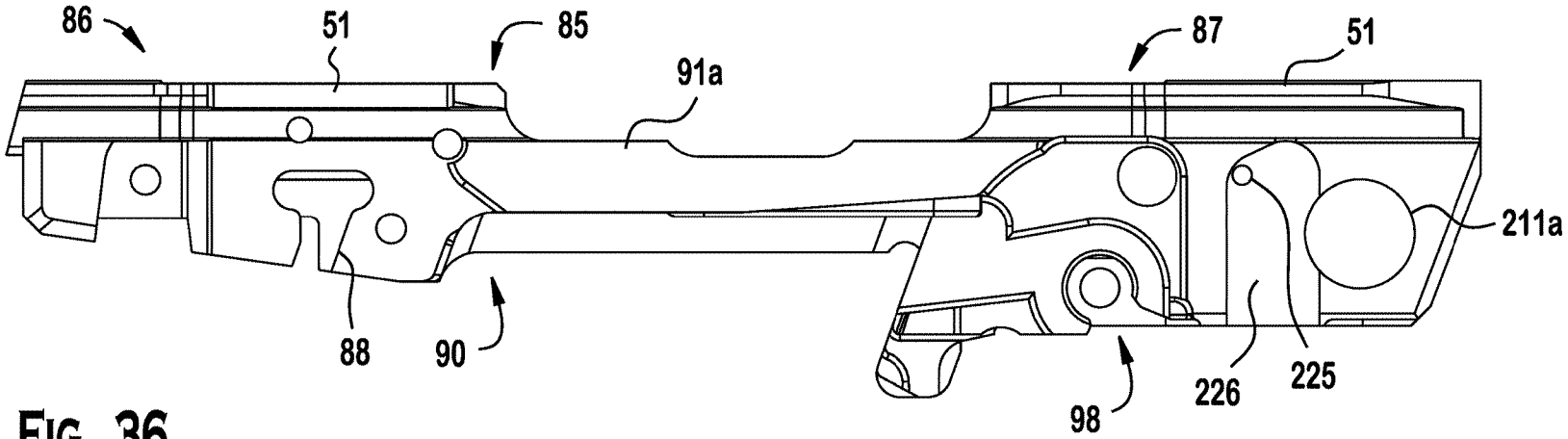
FIG. 36 is a right side view thereof.
Figure 37:
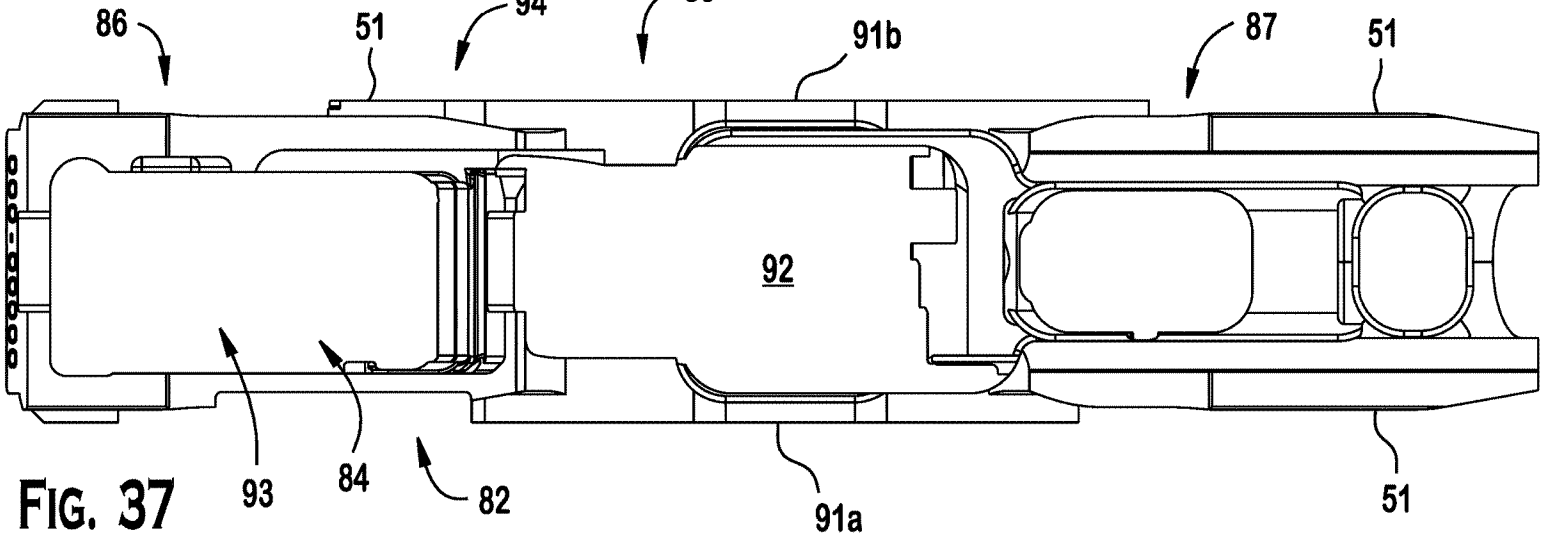
FIG. 37 is a top plan view thereof.
Figure 38:
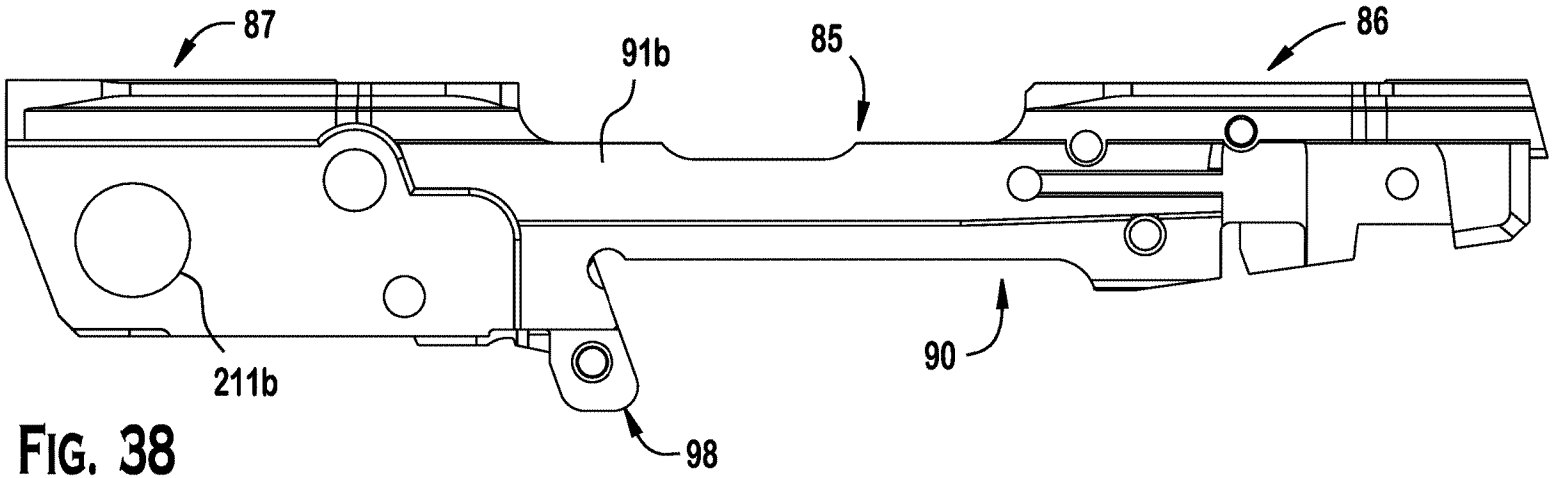
FIG. 38 is a left side view thereof.
Figure 39:
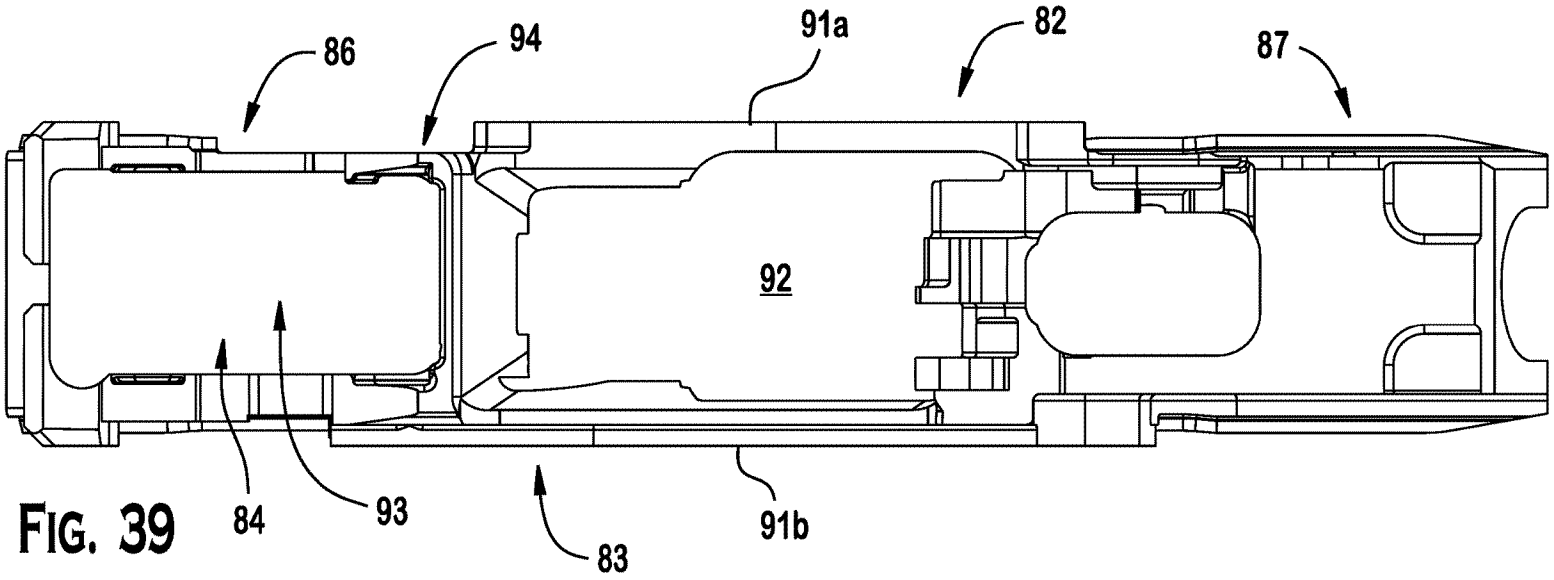
FIG. 39 is a bottom plan view thereof.
Figure 40:
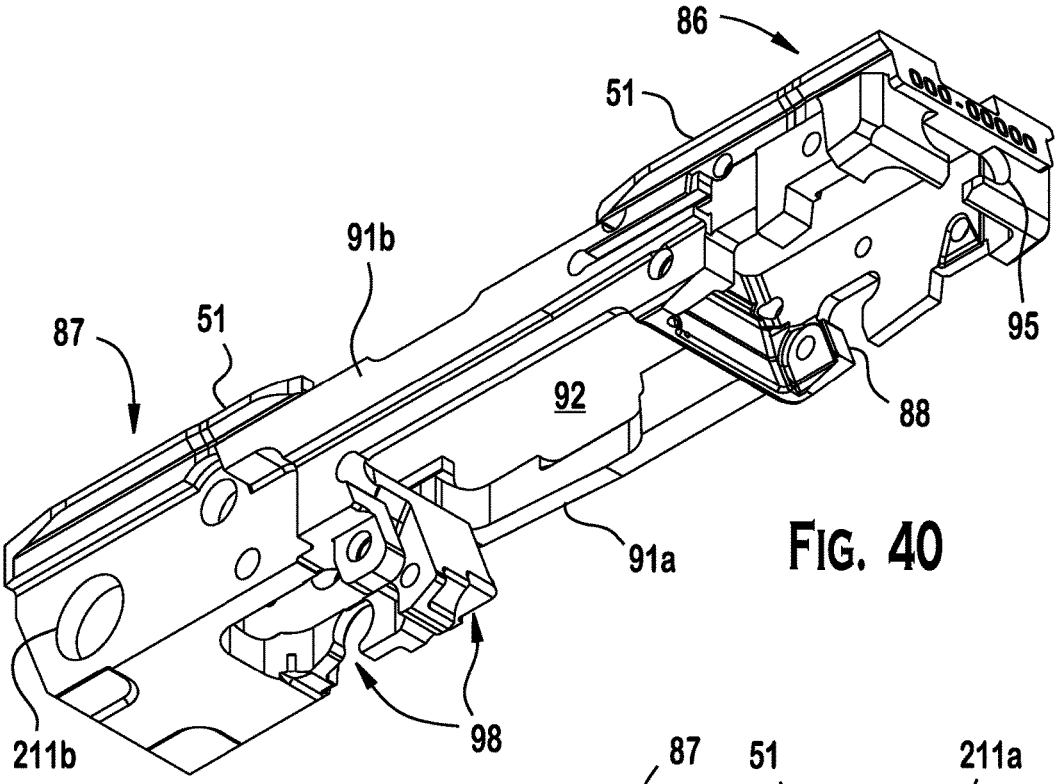
FIG. 40 is a bottom rear perspective view thereof.
Figure 41:
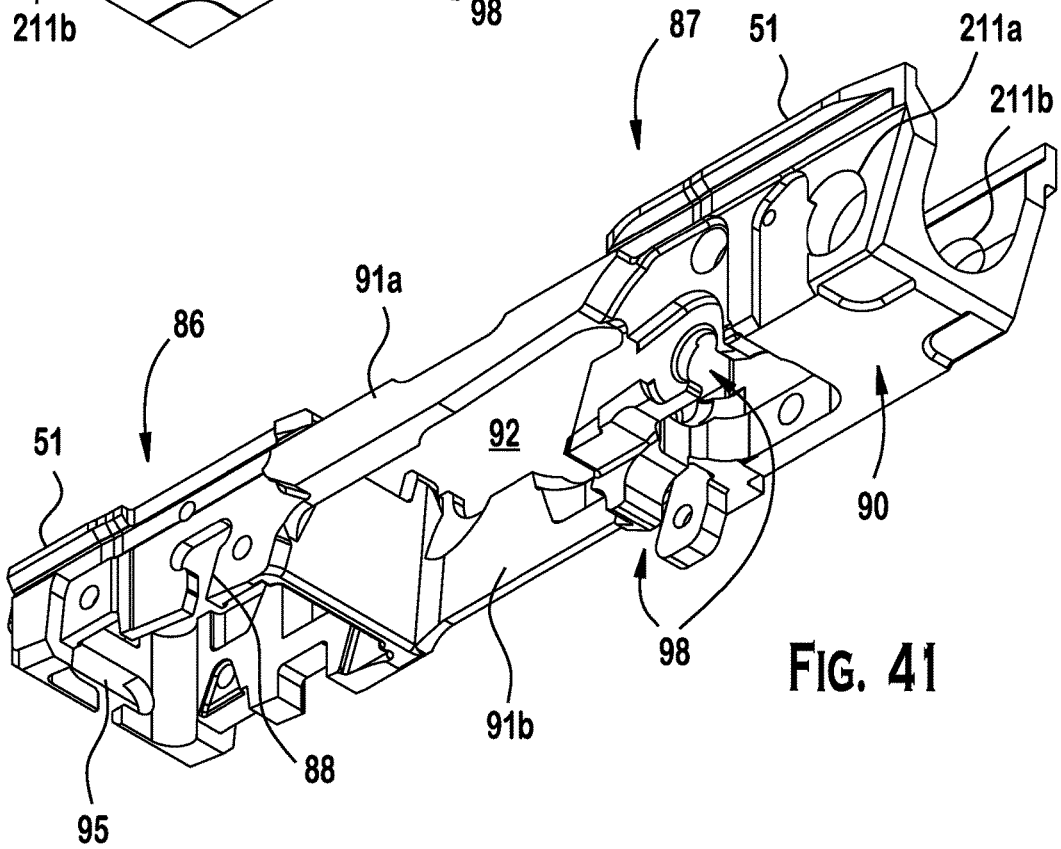
FIG. 41 is a bottom front perspective view thereof.
Figure 42:
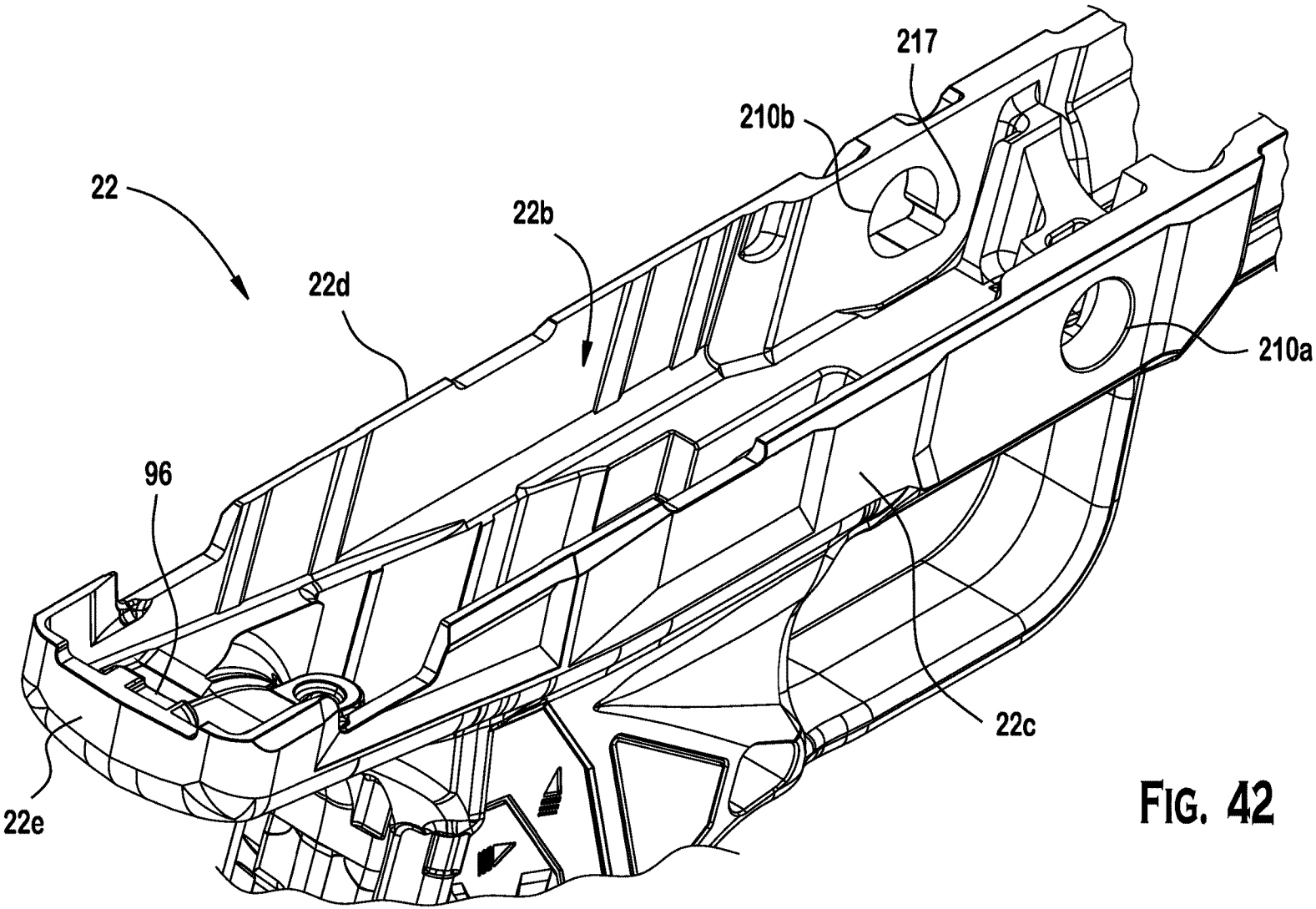
FIG. 42 is a top right perspective view of a portion of the frame.
Figure 43:
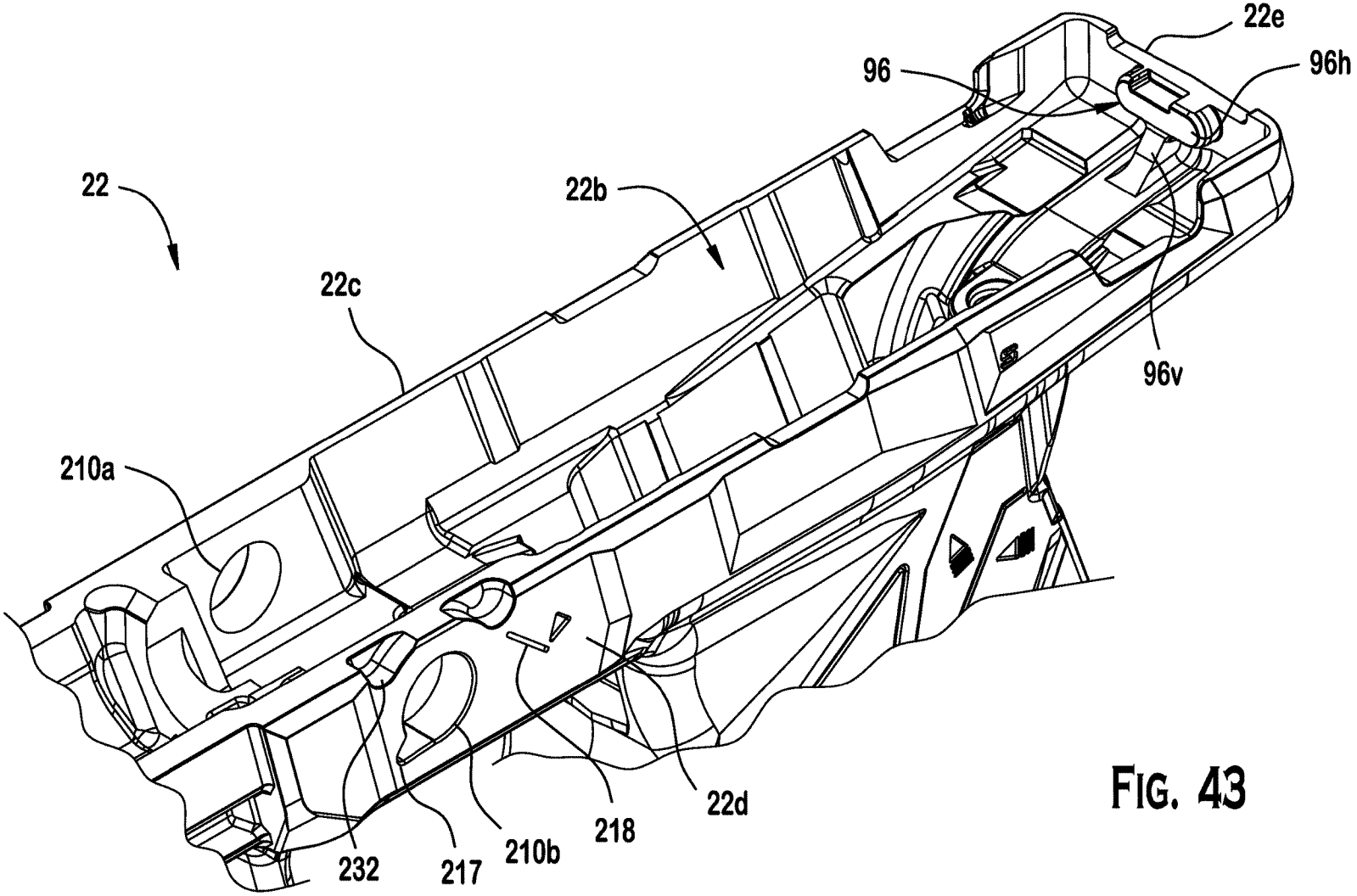
FIG. 43 is a top left perspective view thereof.
Figure 44:
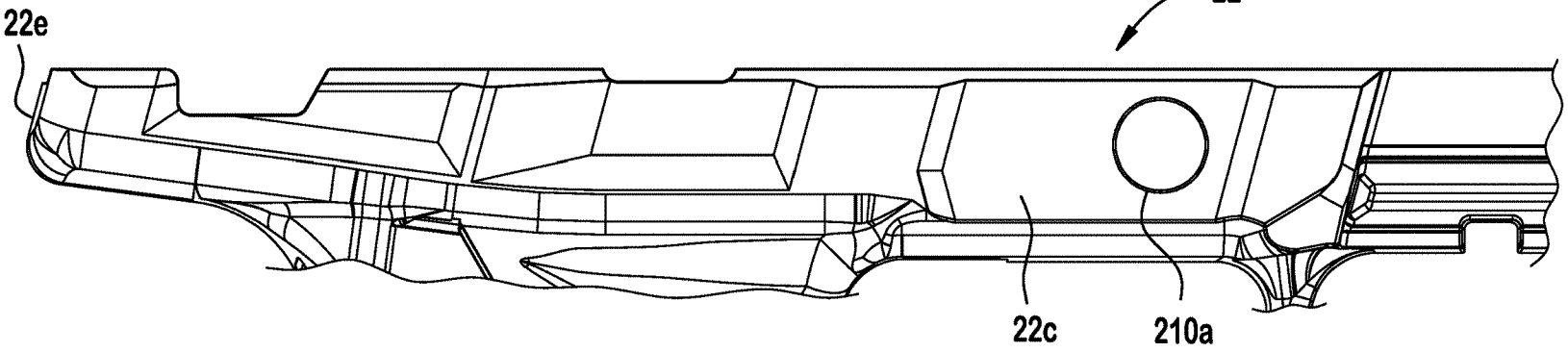
FIG. 44 is a right side view thereof.
Figure 45:
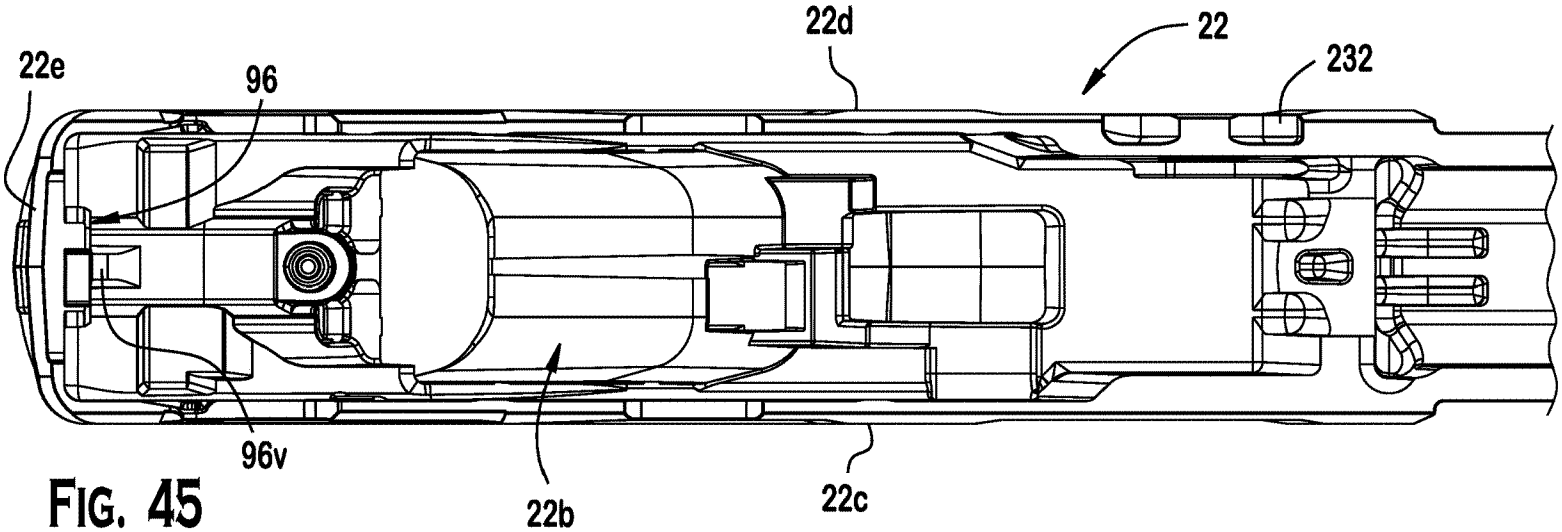
FIG. 45 is a top plan view thereof.
Figure 46:
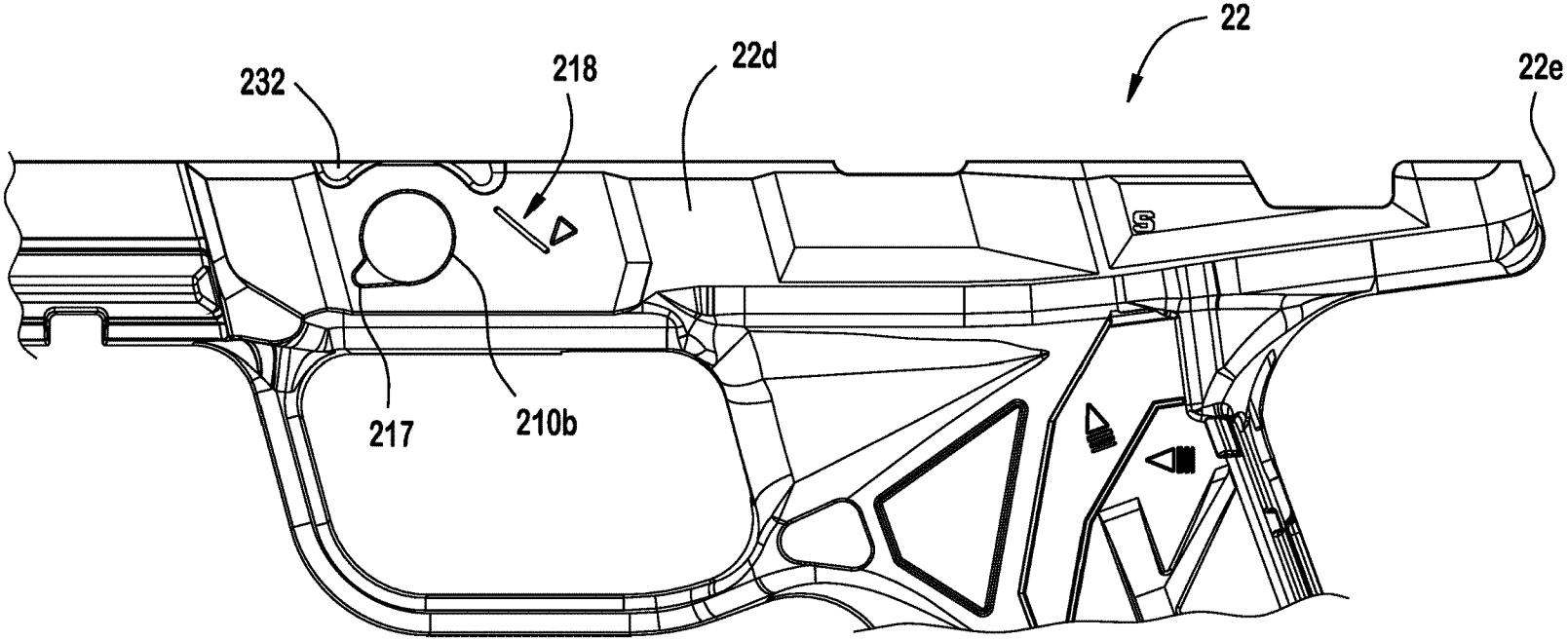
FIG. 46 is a left side view thereof.
Figure 47:
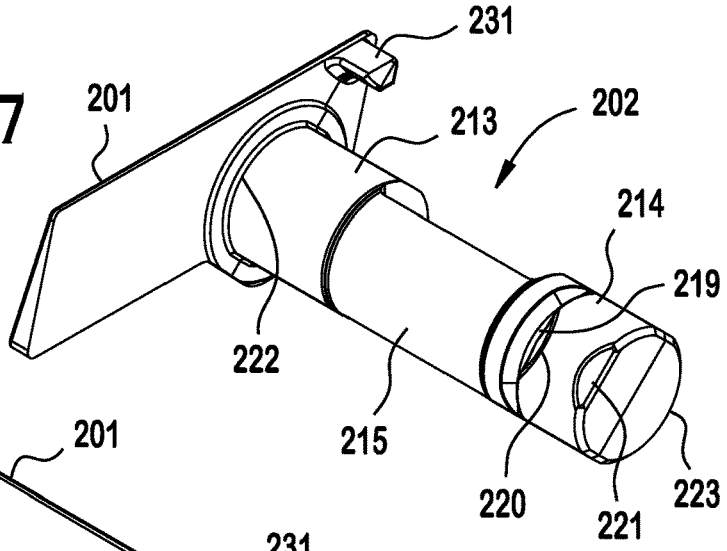
FIG. 47 is a top right perspective view of the takedown pin.
Figure 48:
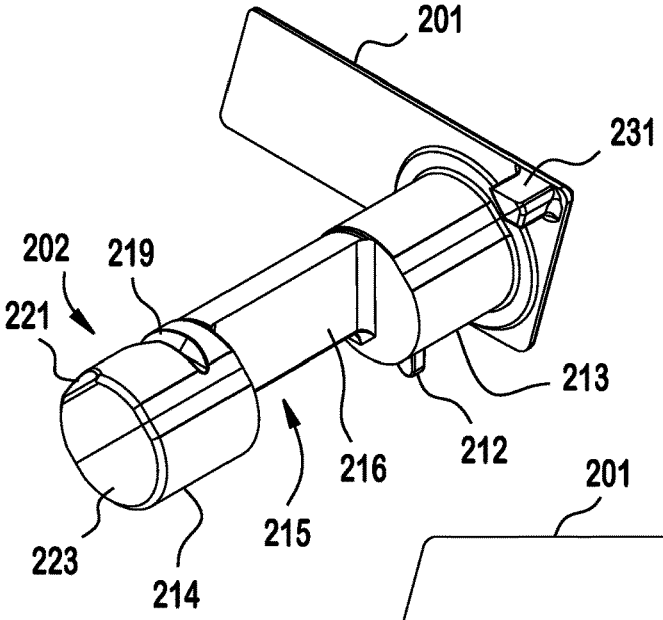
FIG. 48 is a left perspective view thereof.

In the illustrated embodiment, the cam follower protrusion 212 may serve dual duty and further interacts with an arcuately curved cam 230 formed on an enlarged front end of the takedown lever 200 which operates the pistol takedown system mechanism for disassembling the slide from the frame (see, e.g. FIGS. 29-31). Cam 230 defines a curved cam surface which engages cam follower protrusion 212 and may be formed inside a captive opening or loop formed in the front end of the lever 200.

The takedown system comprises an axially movable and elongated takedown link or bar 200 coupled to a transverse takedown pin 202 and operating lever 201 assembly is rotatably mounted to the pistol frame 22. Takedown bar 200 has an inwardly hooked rear end 203 which engages a downwardly open slot 204 formed in the bottom surface of left member **160*b* (reference FIGS. 21, 23, 28-31, and 57-58). In operation, the slide 24 is first pulled rearward on the frame to a removal position. Next, the takedown pin 202 is rotated (via lever 201) 90 degrees in a clockwise direction from the normal horizontal slide blocking position in FIG. 5 to a vertical slide removal position. This moves the takedown bar 200 axially forward towards the front muzzle end of the barrel. An eccentric cam formed by cam follower protrusion 212 on the takedown pin 202 that engages cam 230 on takedown bar 200 turns the rotary motion into linear forward translation of the bar. As the takedown bar 200 moves forward, it pulls and linearly translates the sear connector actuator left member 160*b* (i.e. takedown actuator) forward as well. Movement of left member 160*b* rotates sear connector blocker 120 up out of the way via the cam 162 and cam follower 142 surfaces on the left member and blocker 120 respectively as further described herein. The forward motion of the blocker 120 also cams and pushes on the sear connector 140 to rotate the sear connector forward. This breaks contact with the sear 100. When the slide 24 is subsequently moved back forward for removal from the grip frame 22, the sear 100 is forced downward and drops out of the way of the striker 65 without support from the rotated sear connector 140 so that the slide 24** can be fully removed from the frame.

Figure 5:
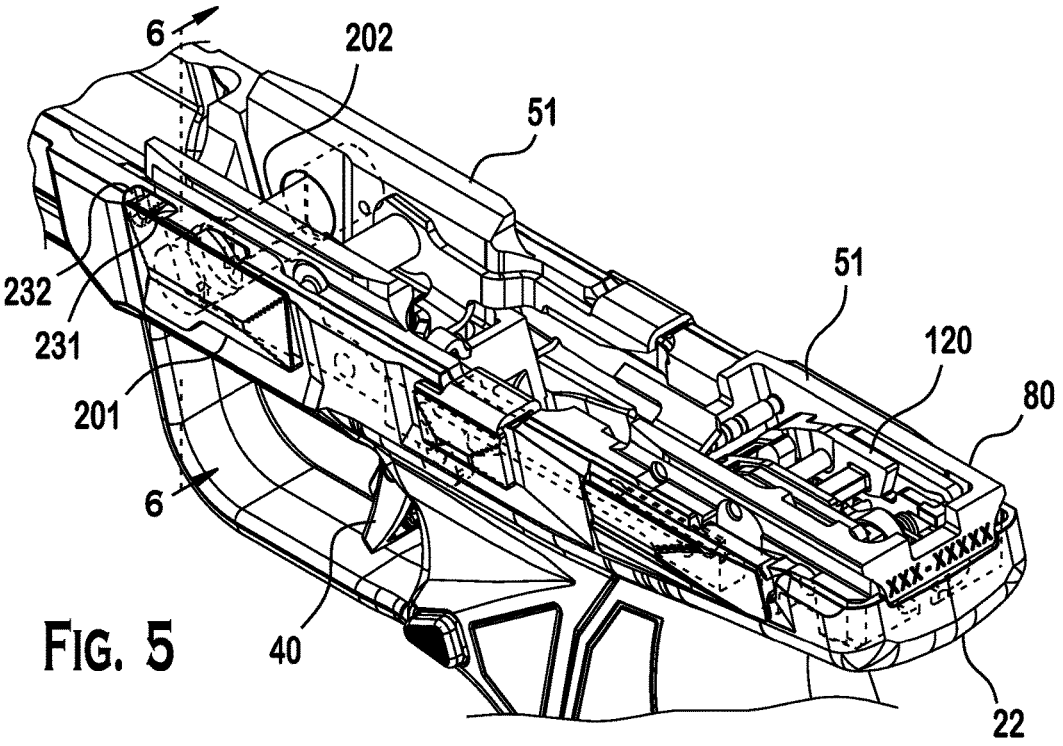
FIG. 5 is a left side perspective view thereof.
Figure 6:
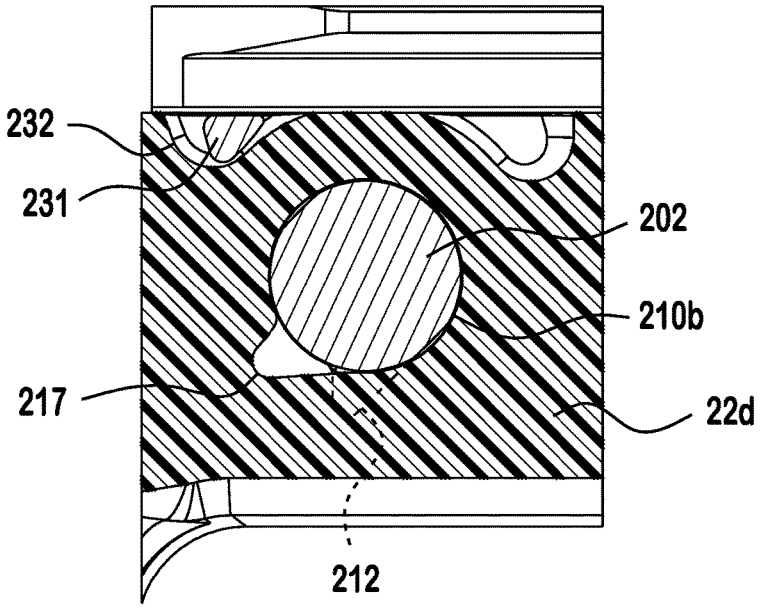
FIG. 6 is an enlarged cross sectional detail view taken from FIG. 5.
Figure 49:
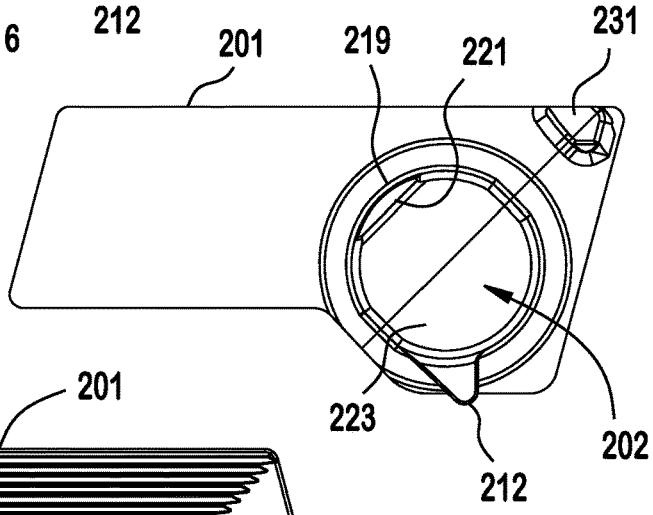
FIG. 49 is a right side view thereof.

FIG. 29 shows the cam follower protrusion 212 of the takedown pin 202 in the normal ready-to-fire operating position (approximately 6 o'clock) in which the takedown operating lever 201 is in a substantially horizontal position (see also FIGS. 5, 6, and 49). FIG. 30 shows the cam follower protrusion 212 in the takedown position (approximately 10 o'clock) in which the operating lever 201 is in a substantially vertical position. Rotating the operating lever 201 downward between the positions shown in FIGS. 29 and 30 engages the follower surface of the cam follower protrusion 212 with the cam 230 on takedown bar 200 as described above, and pulls the takedown bar axially forward which moves sear connector actuator left member 160*b* forward in turn. FIGS. 10, 11, and 31 shows the cam follower protrusion 212 in the takedown pin 202 removal position in which the protrusion is transversely aligned with removal aperture 217 in frame 22 described above. The pin need only be removed if it is desired to remove the firing control housing insert 80 from the pistol to access the firing control mechanism components.

A second interlock feature provided to prevent removal of the takedown pin 202 from the pistol 20 is associated with the right side of the takedown pin and right mounting hole 210*a* in the frame. Referring generally to FIGS. 7-9, 12-14, 20-21, 32, 36, and 47-56, the second end portion 214 of takedown pin 202 includes a circumferentially-extending interlock groove 219 which engages retention spring 224 which blocks removal of the pin from the pistol grip frame 22. Groove 219 may extend partially or completely around the circumference of the pin 202. Retention spring 224 is seated in a shallow depression 226 formed in the right sidewall 82 of firing control housing insert 80. One leg 224*a* of the spring has an end which engages a hole 225 formed in the insert 80 to retain the spring and an opposite leg 224*b* which engages and slides in the groove 219 when the takedown pin 202 is rotated. In one configuration, the spring 224 may be U-shaped as shown; however, other configurations of springs may be used preferably so long as a means of engaging the groove with the spring is provided. Spring 224 is compressible and expandable in shape in the longitudinal direction parallel to longitudinal axis LA when mounted in the position and orientation shown (see, e.g. FIG. 8 or 13) such that the legs 224*a*, 224*b* are either close or farther apart. Other mounting positions and orientations of the spring may be used besides that explicitly shown herein.

To form the second interlock feature, the position of the takedown pin 202 with respect to the interlock groove 219 determines whether or not the pin may be laterally withdrawn from the frame mounting hole 210*a* towards the direction of the left frame sidewall 22*d*. When the pin 202 is in any position other than the obliquely angled removal position (see, e.g. FIGS. 12-14), leg 224*b* of retention spring 224 cannot be removed from the groove. Attempting to pull the takedown from the mounting hole 210*b* would be blocked by the side surfaces of the second end portion 214 of pin 202 that define the groove, thereby forming an interference arrangement. FIGS. 7-9 show takedown pin 202 in the normal operation position with operating lever 201 oriented horizontally and the pin blocked from removal. Groove 219 has a depth which positions leg 224*b* of spring 224 to partially project inwards into the circular mounting hole 210*a* as shown. It should be noted that the cam follower protrusion 212 is also not aligned with removal aperture 217 in frame 22 at the other end of the takedown pin 202 (see, e.g. FIGS. 5 and 6).

Figure 12:
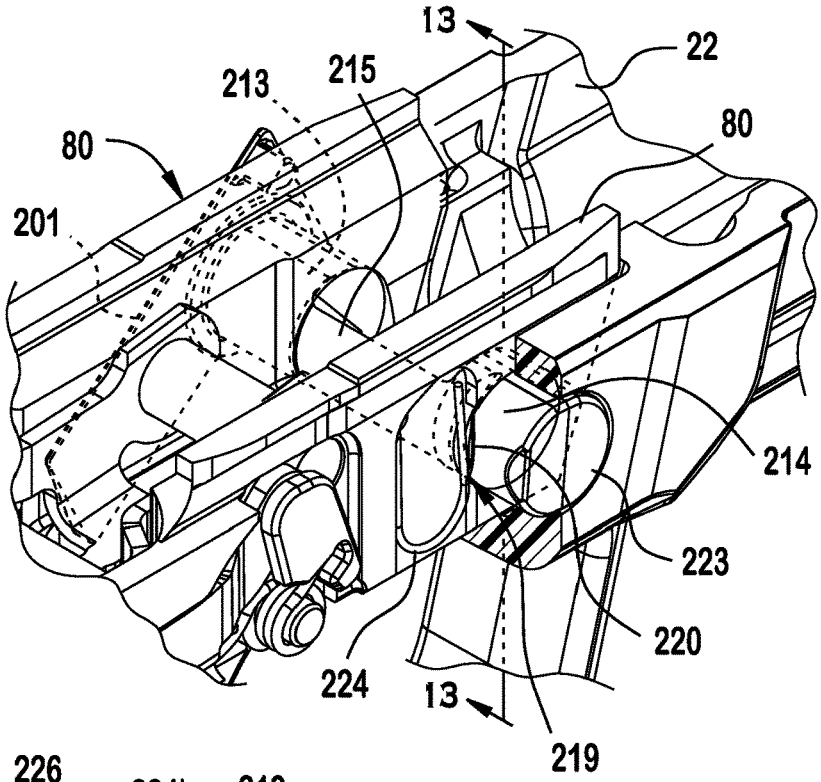
FIG. 12 is a partial right side perspective view showing a portion of the firing control housing insert and frame showing the takedown pin and operating lever in a second removal position.
Figure 13:
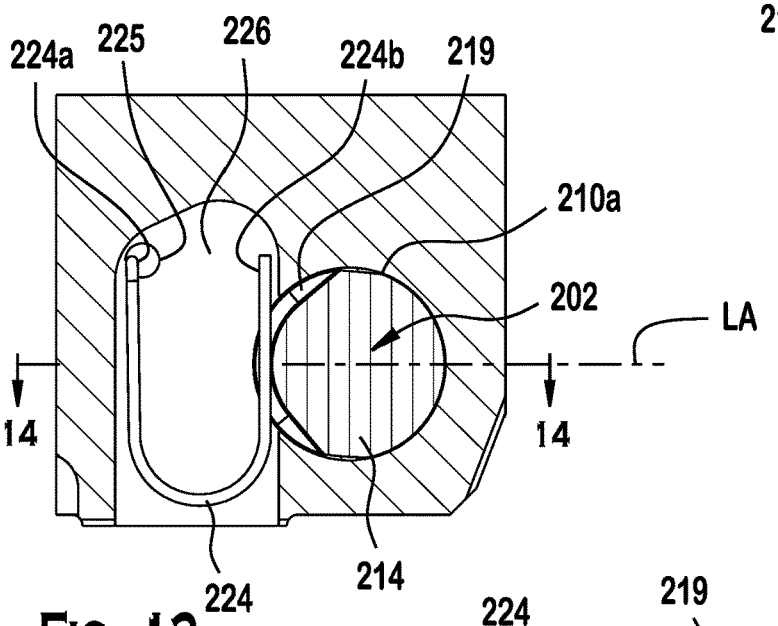
FIG. 13 is a cross sectional detail taken from FIG. 12.
Figure 14:
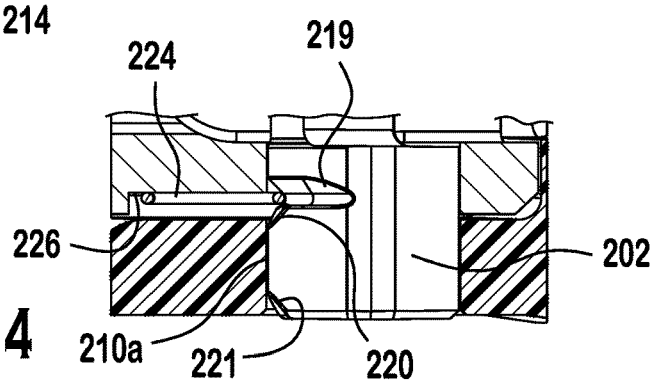
FIG. 14 is a cross sectional detail taken from FIG. 13.

To withdraw the takedown pin 202 from right mounting hole 210*a* in frame 22, the pin is rotated to the obliquely angled removal position shown in FIGS. 12-14. This aligns a chamfered surface recess 220 on pin 202 with leg 224*b* of retention spring 224. Recess 220 communicates with and adjoins the interlock groove 219. Pulling the pin 202 now towards the left sidewall 22*d* of the pistol grip frame 22 with sufficient force causes leg 224*b* to deform and leave the groove 219, thereby moving along the chamfered surface depression 220 up onto the full diameter section of the second end portion 214 of the pin. This action further compresses spring 224 moving leg 224*b* closer to opposing leg 224*a* which remains relatively stationary and may engage the side surface of the grip frame adjacent to depression 226 to prevent rotation of the spring with respect to the frame. The takedown pin 202 may now be removed from mounting hole 210*a* by pulling the pin towards the left sidewall 22*d* of frame 22 wherein the groove and spring no longer are able to block the pin from being withdrawn. Simultaneously, at the opposite end of the takedown pin, the cam follower protrusion 212 is also aligned with removal aperture 217 to prevent engagement of the protrusion with left sidewall 22*d* of grip frame 22 which slides through the aperture with the pin. Accordingly, the cam follower protrusion 212 is cooperatively configured with the surface depression 220 so that both of these pin interlock features are rotationally moved into their pin-removal positions concurrently.

It should be noted that when takedown pin 202 is in a position other than the obliquely angled removal position such as the normal operating or ready-to-fire position shown in FIGS. 7-9, the chamfered surface recess 220 on pin 202 is not aligned with leg 224*b* of retention spring 224 which prevents withdrawal of the pin from frame right mounting hole 210*a*.

In some embodiments, free end 223 of takedown pin 202 may include a second chamfered surface recess 221. This assists with reinsertion of the pin 202 back through frame right mounting hole 210*a* by engaging spring leg 224*b* which moves into and occupies a portion of the hole without the presence of the pin in the hole.

Advantageously the dual takedown pin interlock features provides redundant means for ensuring that the takedown pin is not inadvertently removed from the pistol during normal operation and the ready-to-fire condition. However, in some embodiments the spring 224 and corresponding groove 219 and chamfered surface recess 220 on takedown pin 202 may optionally be omitted forming a single interlock feature on the opposite end of the pin by cam follower protrusion 212. In yet another embodiment contemplated, the cam follower protrusion 212 may be omitted and the spring 224 and groove and chamfered surface recess provided. Any of these arrangements is useable and does not limit the invention.

The firing control housing insert 80 is fixed in position in frame 22 by the rear wall 81 of the insert abuttingly engaging the rear wall 22*e* of the frame and the takedown pin at the front of the insert engaged with both the frame and insert. These features prevent relative movement between the insert and frame under recoil conditions after firing the pistol.

In other embodiments contemplated, the pistol may be hammer-fired in lieu of utilizing a striker. Such an arrangement would include a longitudinally movable firing pin supported by the slide 24 instead of striker 65. The pivotable and cockable hammer may be supported by an appropriately configured firing control housing insert 80. The firing control housing insert is removably retainable by the grip frame 22 of the pistol via the same front and rear mounting systems already described herein.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with removable firing control housing insert, the firearm comprising:

a longitudinal axis;

a frame including a pair of right and left sidewalls, a rear wall extending transversely between the sidewalls, an open top, and an axially elongated cavity accessible through the open top;

an axially elongated firing control housing insert including a front end, a rear end, and pair lateral sidewalls extending between the ends;

the insert detachably mounted in the cavity and configured for holding firing mechanism components, the insert being removable from the cavity through the open top of the frame;

an elongated locking slot formed in a rear wall of the insert engaging a forwardly projecting locking protrusion formed in the rear wall of the frame, the locking slot and protrusion operable to retain a rear end of the insert in the frame.

2. The firearm according to claim 1, further comprising a transversely mounted rotatable pin extending through a first pair of mounting holes formed in a front portion of the insert and further through a second pair of mounting holes formed in the frame, the pin operable to retain a front end of the insert in the frame and including an elongated radial extending operating lever on a first end of the pin.

3. The firearm according to claim 2, further comprising a first interlock feature formed on the pin and configured to interface with the frame such that the pin is laterally removable from the first and second pairs of holes in a first rotational removal position and not laterally removable from the first and second pairs of holes in a second rotational engagement position.

4. The firearm according to claim 3, wherein the first interlock feature comprises a radially extending retention protrusion disposed near the first end of the pin and interposed between frame and firing control housing insert, the retention protrusion configured to engage the frame when the pin is in the second rotational engagement position to prevent removal of the pin through the first and second pairs of holes, and further to disengage the frame when the pin is in the first rotational removal position to allow removal of the pin through the first and second pairs of holes.

5. The firearm according to claim 4, wherein rotating the pin via the operating lever to the first rotational position aligns the retention protrusion with a complementary configured removal aperture associated with a first one of the mounting holes in the frame, the retention protrusion being laterally removable from the frame through the removal aperture with the pin in the first rotational removal position.

6. The firearm according to claim 5, wherein the operating lever and retention protrusion are mutually configured and arranged so that placing the operating lever in a 45 degree downward position obliquely angled with respect to longitudinal axis aligns the retention protrusion with removal aperture.

7. The firearm according to claim 4, wherein the pin is a takedown pin having a cylindrical shape and comprising a first end portion, a second end portion, and a middle portion including a flat bypass surface operable to allow removal of a reciprocating slide movably supported by firing control housing insert.

8. The firearm according to claim 7, wherein the retention protrusion is a cam follower protrusion which is positioned and operable to engage a mating cam surface formed on an axially elongated and movable takedown bar disposed between the firing control housing insert and the frame.

9. The firearm according to claim 8, wherein the cam surface on the takedown bar is arcuately curved such that rotating the pin causes the retention protrusion to linearly move the takedown bar.

10. The firearm according to claim 4, further comprising a second interlock feature disposed near a second end of the pin opposite the first end of the pin, the second interlock feature comprising a retention spring having a deformable leg engaged with a circumferentially extending interlock groove formed in the second end of the pin, the second interlock operable such that the pin is removable from the firing control housing insert in the first rotational removal position and not removable from the firing control housing insert in the second rotational engagement position.

11. The firearm according to claim 10, further comprising a chamfered surface recess formed on the second end of the pin which adjoins the interlock groove, the surface recess rotatable into alignment with the leg of the spring when the pin is in the first rotational removal position which causes the leg of the spring be removed from the interlock groove through the surface recess when the pin is laterally removed from the firing control housing insert.

12. The firearm according to claim 1, wherein the locking protrusion and locking slot are T-shaped.

13. The firearm according to claim 2, further comprising upward limit stop comprising an inwardly extending limit tab formed on the operating lever that is positioned to engage an upwardly open pocket formed in the frame 22 when the operating lever is rotated into a horizontal operating position.

14. A frame and firing control housing insert assembly for a firearm, the assembly comprising:

an axially elongated firing control housing insert removably inserted into an upwardly open cavity of a firearm frame, the insert including a longitudinal axis, a front portion configured for mounting a trigger assembly of the firearm, a rear portion configured for mounting components of a firing mechanism of the firearm, and a pair of spaced apart struts connecting the front and rear portions;

a rear securement feature comprising a locking slot formed in a rear wall of the insert engaged with a complementary configured locking protrusion formed in a rear wall of the frame;

a front securement feature comprising a transversely mounted rotatable retention pin inserted laterally through a first pair of holes in the front portion of the insert and a second pair of holes in the frame;

a radially extending operating lever arranged on a first end of the pin for rotating the pin; and an interlock feature comprising a radially extending retention protrusion on the pin interposed between the insert and frame proximate to a first hole of the second pair of holes in the frame;

the pin being rotatable between a first removal position wherein the protrusion is aligned to pass through a complementary configured frame aperture allowing the pin to be removed from the frame, and a second engagement position wherein the protrusion is not aligned with the aperture to engage the frame and prevent the pin from being removed from the frame.

15. The assembly according to claim 14, wherein the first hole of the second pair of holes in the frame has an asymmetric shape and the removal aperture forms an integral part of the first hole along its perimeter.

16. The assembly according to claim 15, wherein the retention protrusion and removal aperture have a triangular shape.

17. The assembly according to claim 14, wherein the pin is a takedown pin having a cylindrical shape and comprising a first end portion, a second end portion, and a middle portion including a flat bypass surface.

18. The assembly according to claim 17, wherein the retention protrusion is a cam follower protrusion which engages a mating cam surface formed on an axially elongated takedown bar disposed between the insert and the frame, and wherein rotating the pin linearly moves the takedown bar in the direction of the longitudinal axis.

* * * * *